US010183214B2

(12) United States Patent
Katz

(10) Patent No.: US 10,183,214 B2
(45) Date of Patent: Jan. 22, 2019

(54) TABLE GAME MULTIPLIER SYSTEM AND METHOD THEREFOR

(71) Applicant: Howard B. Katz, Boca Raton, FL (US)

(72) Inventor: Howard B. Katz, Boca Raton, FL (US)

( * ) Notice: Subject to any disclaimer, the term of this patent is extended or adjusted under 35 U.S.C. 154(b) by 0 days.

(21) Appl. No.: 15/964,696

(22) Filed: Apr. 27, 2018

(65) Prior Publication Data

US 2018/0311568 A1 Nov. 1, 2018

Related U.S. Application Data

(60) Provisional application No. 62/492,440, filed on May 1, 2017.

(51) Int. Cl.

| | |
|---|---|
| ***G07F 17/32*** | (2006.01) |
| ***A63F 9/24*** | (2006.01) |
| ***A63F 3/00*** | (2006.01) |
| ***G06Q 50/34*** | (2012.01) |

(52) U.S. Cl.

CPC ..... *A63F 9/24* (2013.01); *A63F 3/00157* (2013.01); *G06Q 50/34* (2013.01); *G07F 17/323* (2013.01); *G07F 17/3272* (2013.01); *A63F 2003/00164* (2013.01); *A63F 2003/00167* (2013.01); *A63F 2009/2402* (2013.01); *A63F 2009/2435* (2013.01); *A63F 2009/2488* (2013.01)

(58) Field of Classification Search

CPC ..... G07F 17/32

See application file for complete search history.

(56) References Cited

U.S. PATENT DOCUMENTS

| | | | | |
|---|---|---|---|---|
| 4,467,424 | A | 8/1984 | Hedges et al. | |
| 6,001,016 | A | 12/1999 | Walker et al. | |
| 8,403,758 | B2 | 3/2013 | Hornik et al. | |
| 9,514,609 | B2 | 12/2016 | Katz et al. | |
| 9,582,182 | B2 | 2/2017 | Katz et al. | |
| 9,747,753 | B2 | 8/2017 | Katz et al. | |
| 2002/0094869 | A1 | 7/2002 | Harkham | |
| 2003/0003997 | A1 * | 1/2003 | Vuong | G07F 17/32 463/42 |
| 2004/0162144 | A1 | 8/2004 | Loose et al. | |

(Continued)

OTHER PUBLICATIONS

Mohegan Sun launches online casino in New Jersey All Gaming All the World Casino Journal http://www.casinojournal.com/articles/89941-mohegan-sun-launches-online-casino-in-new-jersey.

*Primary Examiner* — Omkar Deodhar

(74) *Attorney, Agent, or Firm* — Weiss & Moy, P.C.; Karen J. S. Fouts; Jeffrey D. Moy

(57) ABSTRACT

A table game multiplier system and method expands the play of a craps table by allowing a player to wager on a live-action craps table game being played at a table in a system operator, such as a casino or other suitable establishment, without requiring the person to be physically present at the craps table. The system allows the live-action craps table game to be virtually tiered or duplicated, thereby allowing a set of additional players to wager on a craps table identical to the one being played at a particular system operator. The additional players may connect to the table game multiplier system via an electronic telecommunication device such as, but not limited to, a smartphone, a tablet computer, or a personal computer, which may communicate with the system operator to allow the electronic placing of wagers on the tiered craps table.

19 Claims, 12 Drawing Sheets

(56) References Cited

U.S. PATENT DOCUMENTS

| | | | | |
|---|---|---|---|---|
| 2006/0217199 | A1 | 9/2006 | Adcox et al. | |
| 2008/0176637 | A1* | 7/2008 | Letovsky | G07F 17/32 463/20 |
| 2008/0261682 | A1 | 10/2008 | Phillips et al. | |
| 2010/0171267 | A1* | 7/2010 | Walker | G07F 1/06 273/274 |
| 2010/0227675 | A1* | 9/2010 | Luxton | G07F 17/32 463/25 |
| 2010/0279764 | A1 | 11/2010 | Allen et al. | |
| 2011/0300926 | A1 | 12/2011 | Englman et al. | |
| 2012/0004037 | A1 | 1/2012 | Hill | |
| 2013/0040730 | A1 | 2/2013 | Barclay et al. | |
| 2014/0106869 | A1 | 4/2014 | Dewaal | |
| 2014/0370971 | A1 | 12/2014 | Kelly et al. | |

* cited by examiner

TABLE GAME MULTIPLIER SYSTEM AND METHOD THEREFOR

CROSS-REFERENCE TO RELATED APPLICATION

This non-provisional application claims priority to U.S. Provisional Application Ser. No. 62/492,440 titled CRAPS TABLE GAME MULTIPLIER which was filed on May 1, 2017 in the name of Howard B. Katz, the inventor herein, which is incorporated herein by reference in its entirety.

FIELD OF THE INVENTION

The present invention relates generally to the field of casino games and, more particularly, to a table game multiplier system and method that expands the play of a craps table by allowing a player to wager on a live-action craps table game being played at a table in a casino or other gaming establishment without requiring the player to be physically present at the craps table.

BACKGROUND OF THE INVENTION

Craps is dice game that is popular in casinos and that may also be played outside of a casino setting. Casino craps is also known as "shooting dice" or "rolling dice." Casino craps is a game played by multiple players or a single player betting on the outcome of the dice roll or rolls. One player rolls the dice and is typically referred to as the "shooter" or "roller." Each player may take a turn in rolling the dice, if desired.

The rules of play for conventional casino craps are well known. In general, in craps, the players make wagers on the outcome of a roll of a pair of standard, six-sided dice or a series of rolls of a pair of dice, as may be determined by the casino in certain cases. The dice are first rolled by the shooter (the shooter's "initial come out" roll) in order to establish a point, which may be 4, 5, 6, 8, 9, or 10. Any other number rolled results in a pass line bet being either won (i.e. rolling a 7 or 11, referred to as a "natural winner") or lost (i.e., rolling a 2, 3, or 12, referred to as a "natural loser"). The shooter will continue to roll the dice until he or she establishes a point. Once a point is established, the shooter will continue to roll the dice until he or she either rolls the point again (referred to as "making the pass" or "making the point") or rolls a seven (referred to as a "seven out" or "sevening out"). If the shooter rolls the point again, then a pass line bet is won and the shooter may then roll the dice again for another come out. The shooter will continue to roll the dice until he or she sevens out, at which time the shooter loses his or her right to roll the dice. The dice are then passed to a new shooter who makes his or her initial come out roll.

In a typical casino craps setting, employees and players stand at a large, elongated craps table. Typically, the craps table has a double layout that is displayed on a felt playing surface. The layout provides space for the various betting options available in the game, and may also display the odds of particular rolls and/or set forth payouts for various rolls. The layout typically has a left side section, a center section, and a right side section, with the two side sections mirroring each other. A typical craps table may accommodate up to sixteen players at any given time.

The game of craps is considered by many to be fun and exciting. Many players are drawn to craps for this reason and also due to its fast pace and lively atmosphere, particularly in the casino setting. Players and observers alike often roar or cheer with each roll of the dice. However, there are a number of drawbacks associated with the typical casino craps game. In general, space is limited around the craps table, which limits the number of players that may play at any given time. A crowded craps table may discourage would-be players, who may tire of waiting their turn to play and elect to do something else, such as playing other casino games or leaving the casino to do something else entirely. This, in turn, limits the casino's revenue from craps. While casinos can increase their craps revenue by providing additional craps tables, there are of course limits to the number of craps tables that a given casino may accommodate, due to space and other limitations.

Further, each craps table game is typically operated by multiple casino employees, who may be referred to as a "table crew." A typical table crew may include at least four casino personnel, including a boxman (who oversees the craps game, manages the chips used for the game, and is responsible for handling all of the cash presented by the players), a stickman (who is responsible for operating an elongated stick that is used to move the dice around the craps table and who announces the results of each roll of each die of the pair of dice) and one or more dealers (who are responsible for managing all the bets placed by the players and who collect losing bets from and pay winning bets to the players). Therefore, a casino offering multiple craps tables will need to employ multiple table crews with numerous employees to operate them.

A need therefore exists for a table game system and method that expands the play of a craps table by allowing a player to wager on a live-action craps table game being played at a table in a casino or other gaming establishment without requiring the player to be physically present at the craps table. A need further exists for a table game system and method that allows one craps table with one table crew to service an unlimited number of players wagering on any one roll of each die of the pair of dice. The present invention satisfies these needs and provides other, related advantages.

SUMMARY

This summary is provided to introduce a selection of concepts in a simplified form that are further described below in the DETAILED DESCRIPTION OF THE INVENTION. This summary is not intended to identify key features of the claimed subject matter, nor is it intended to be used as an aid in determining the scope of the claimed subject matter.

In accordance with one embodiment of the present invention, a table game multiplier system is disclosed. The system comprises: at least one live-action craps table residing at a system operator, the system operator having a plurality of servers; a network configured for communication between at least one server of the plurality of servers and at least one electronic telecommunication device operated by at least one tiered player enrolled with the system operator, wherein the at least one tiered player is located remotely from the live-action craps table; a game client, wherein the game client comprises application software configured to run on the at least one electronic telecommunication device, wherein the application software is configured to display an interactive tiered craps table on the at least one electronic telecommunication device, wherein the tiered craps table is a virtual representation of at least a portion of a layout of the live-action craps table, and wherein the tiered craps table is configured for accepting at least one wager placed by the at least one tiered player on a game of craps being played at the at least one live-action craps table, as if the at least one wager was being placed at the at least one live-action craps table; a virtual chip tray server communicatively coupled to the game client, wherein the virtual chip tray server is configured for the at least one tiered player to purchase virtual chips for placing the at least one wager on the tiered craps table; a game server communicatively coupled to the game client; and a pit control communicatively coupled to the game server, wherein the pit control is configured to transmit to the game server an outcome of each roll of each die of a pair of dice performed by a shooter in the game of craps being played at the live-action craps table.

In accordance with another embodiment of the present invention, a method for allowing tiered players to place wagers on an outcome of at least one roll of each die of a pair of dice occurring during a game of craps being played on at least one live-action craps table is disclosed. The method comprises the steps of: at least one tiered player logging in to a table game multiplier system, the tiered player located remotely from the at least one live-action craps table, wherein the system comprises: the at least one live-action craps table, wherein the at least one live-action craps table resides at system operator, the system operator having a plurality of servers; a network configured for communication between at least one server of the plurality of servers and at least one electronic telecommunication device operated by at least one tiered player enrolled with the system operator; a game client, wherein the game client comprises application software configured to run on the at least one electronic telecommunication device, wherein the application software is configured to display an interactive tiered craps table on the at least one electronic telecommunication device, wherein the tiered craps table is a virtual representation of at least a portion of a layout of the live-action craps table, and wherein the tiered craps table is configured for accepting at least one wager placed by the at least one tiered player on a game of craps being played at the at least one live-action craps table, as if the at least one wager was being placed at the at least one live-action craps table; a virtual chip tray server communicatively coupled to the game client, wherein the virtual chip tray server is configured for the at least one tiered player to purchase virtual chips for placing the at least one wager on the tiered craps table; a game server communicatively coupled to the game client; and a pit control communicatively coupled to the game server, wherein the pit control is configured to transmit to the game server an outcome of each roll of each die of the pair of dice performed by a shooter in the game of craps being played at the live-action craps table; identifying via the system at least the shooter that is present and ready to commence play of the game of craps at the at least one live-action craps table; the at least one tiered player placing at least one wager on the tiered craps table; the shooter rolling the dice at the live-action craps table; entering into the system data regarding the outcome of the roll of each die of the pair of dice; transmitting to the game server the data regarding the outcome of the roll of each die of the pair of dice; determining, at the game server, whether the tiered player's wager is one of a winning wager, a losing wager, and a no-action wager; communicating to the game client the data regarding the outcome of the roll of each die of the pair of dice; and updating a system account balance of the at least one tiered player depending upon the outcome of the roll of each die of the pair of dice, wherein: the amount of the wager placed by the at least one tiered player is credited to the system account balance wherein the at least one tiered player's wager is a winning wager; and the amount of the wager placed by the at least one tiered player is debited from the system account balance wherein the at least one tiered player's wager is a losing wager.

In accordance with another embodiment of the present invention, a table game multiplier system is disclosed. The system comprises: at least one live-action craps table residing at a system operator, the system operator having a plurality of servers; a network configured for communication between the at least one server of the plurality of servers and at least one electronic telecommunication device operated by at least one tiered player enrolled with the system operator, wherein the tiered player is located remotely from the live-action craps table; a management system connected to the network; a game client, wherein the game client comprises application software configured to run on the at least one electronic telecommunication device, wherein the application software is configured to display an interactive tiered craps table on the at least one electronic telecommunication device, wherein the tiered craps table is a virtual representation of at leak a portion of a layout of the live-action craps table, and wherein the tiered craps table is configured for accepting at least one wager placed by the at least one tiered player on a game of craps being played at the at least one live-action craps table, as if the at least one wager was being placed at the at least one live-action craps table; a virtual chip tray server communicatively coupled to the management system and to the game client, wherein the virtual chip tray server is configured for the at least one tiered player to purchase virtual chips for placing the at least one wager on the tiered craps table, wherein the virtual chip tray server has a first database containing information for at least one virtual chip tray utilized by the at least one tiered player, and a first processor configured to access the first database and to execute a set of program instructions causing the first processor to process a first input received from the at least one electronic telecommunication device operated by the at least one tiered player, wherein the first input comprises at least one e-commerce transaction initiated by the at least one tiered player for purchasing the virtual chips; a game server communicatively coupled to the game client, wherein the game server has a second database containing information for the at least one tiered player and a second processor configured to access the second database and to execute a set of program instructions causing the second processor to process a second input received from the at least one electronic telecommunication device operated by the at least one tiered player, wherein the second input comprises the at least one wager made by the at least one tiered player on the game of craps being played at the at least one live-action craps table; a pit control communicatively coupled to the game server, wherein the pit control is configured to transmit to the game server an outcome of each roll of each die of a pair of dice performed by a shooter in the game of craps being played at the live-action craps table; an electronic tote board communicatively coupled to the pit control, wherein the tote board is configured to display the outcome of each roll of each die of the pair of dice; a video stream broadcast to the game client, wherein video for the video stream is generated by at least one video camera recording the live-action craps table; wherein the second processor is further configured to execute a set of program instructions causing the processor to process a third input received from the pit control, wherein the third input comprises the outcome of each roll of each die of the pair of dice; and wherein the first processor is further configured to execute a set of program instructions causing the first processor to update a system account balance of the at least one tiered player depending upon the outcome of each roll of each die of the pair of dice, wherein: the amount of the wager placed by the at least one tiered player is credited to the system account balance wherein the at least one tiered player's wager is a winning wager; and the amount of the wager placed by the at least one tiered player is debited from the system account balance wherein the at least one tiered player's wager is a losing wager.

BRIEF DESCRIPTION OF THE DRAWINGS

The present application is further detailed with respect to the following drawings. These figures are not intended to limit the scope of the present application, but rather, illustrate certain attributes thereof.

DETAILED DESCRIPTION OF THE INVENTION

Figure 1:
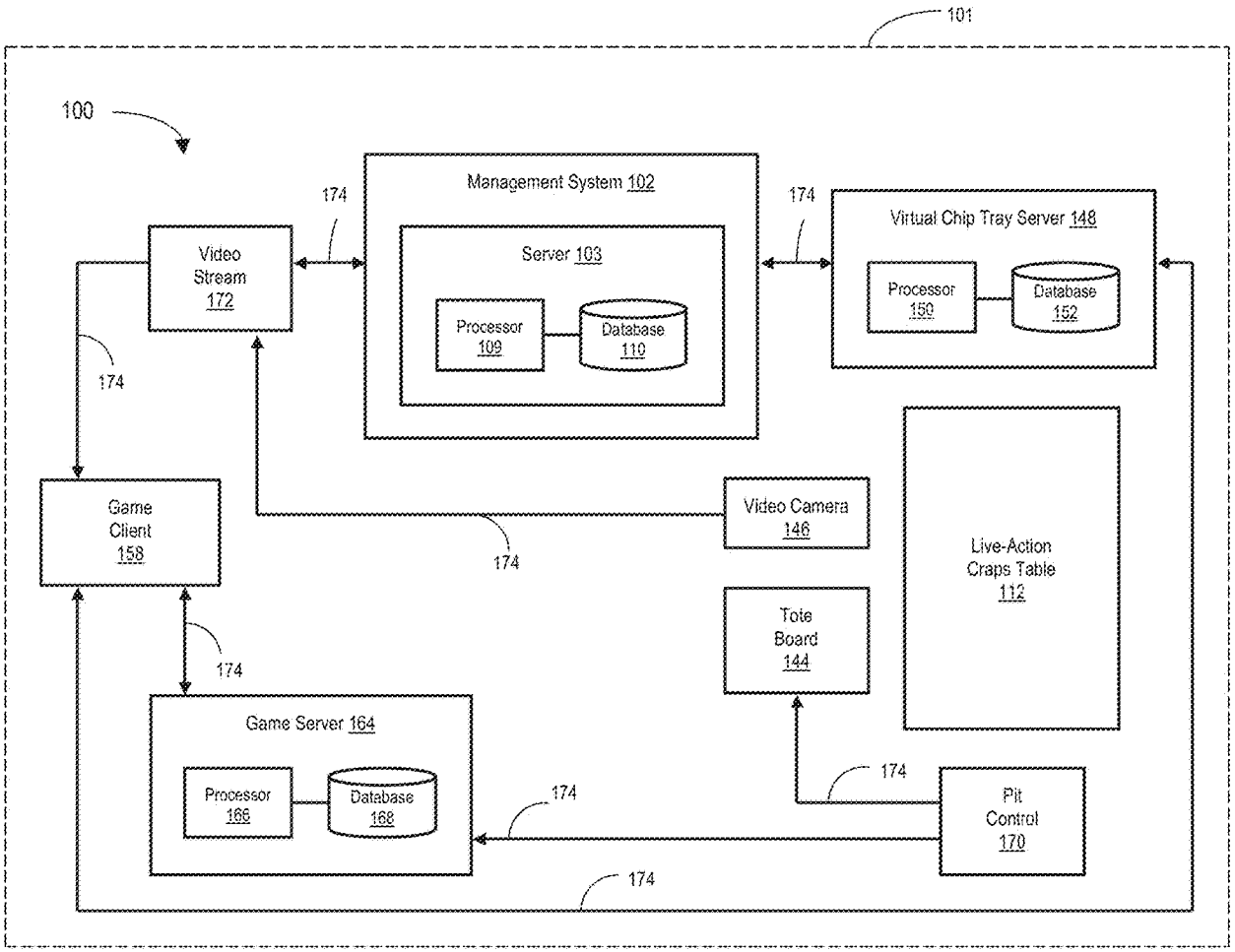
FIG. 1 is a block diagram of an exemplary table game multiplier system according to one or more aspects of the present invention.

The description set forth below in connection with the appended drawings is intended as a description of presently preferred embodiments of the disclosure and is not intended to represent the only forms in which the present disclosure may be constructed and/or utilized. The description sets forth the functions and the sequence of steps for construing and operating the disclosure in connection with the illustrated embodiments. It is to be understood, however, that the same or equivalent functions and sequences may be accomplished by different embodiments that are also intended to be encompassed within the spirit and scope of this disclosure.

The present invention proposes a unique and new table game multiplier system and method to include additional players in a craps table game beyond those allowed by the physical capacity of the craps table. This new table game multiplier system and method does not require each additional player to be physically present at the craps table. The present invention allows a single craps table with a single table crew to service an unlimited number of players wagering on any one roll of each die of the pair of dice.

The table game multiplier system provides a method that allows additional players to wager on any one roll of each die of the pair dice by the shooter (aka roller) who is physically present at a craps table where a live-action craps table game is being played (the "live-action craps table"). The table game multiplier system allows the live-action craps table game to be virtually tiered or duplicated, thereby allowing a set or sets of additional players to play a "tiered craps game" and to wager, in real time, on a craps table identical to the one being played at a particular casino (the "tiered craps table"). A potential player desiring to join a game of craps without being physically present at a craps table may connect (e.g. log in) to the table game multiplier system of a casino or other suitable establishment (hereinafter "casino") via an electronic telecommunication device such as, but not limited to, a smartphone, a tablet computer (e.g. iPad®), or a personal computer. The electronic telecommunication device may communicate with the casino and the casino, in turn, may electronically place the person's desired wager on the tiered craps table at which the person (the "tiered player") is signed in or playing.

A purpose of the table game multiplier system and method is to increase participation in the craps table game and thereby increase the amount of bets that are placed. Further, a casino employing the table game multiplier system and method will be able to use fewer employees while increasing the number of players that can be accommodated for a given game of craps. The multiplier of potential profits for the casino increases geometrically without the need for the casino to undertake major capital expenditures or obtain additional real estate. In addition, it is envisioned that the table game multiplier system and method will create a social event allowing many people to participate in the wagering process at the same craps table game.

Figure 2:
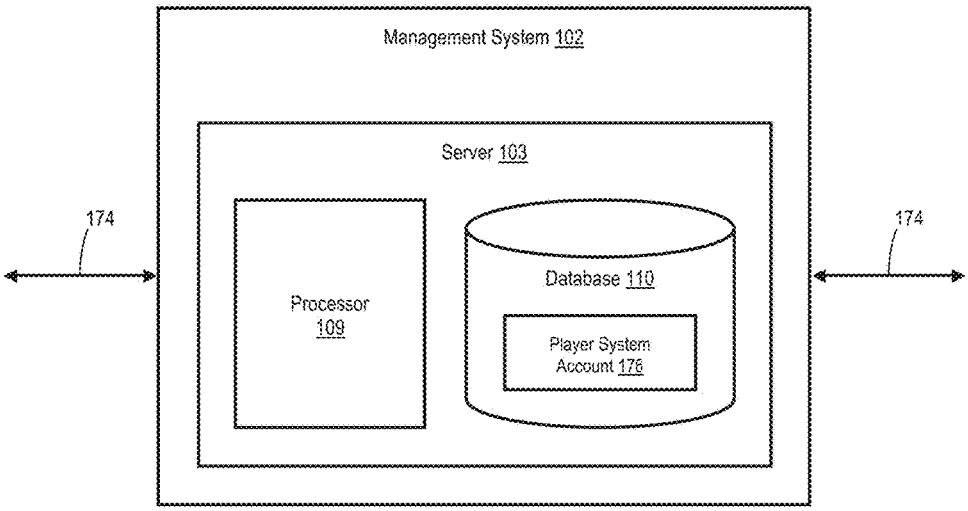
FIG. 2 is a more detailed diagram of components of the system of FIG. 1.
Figure 3:
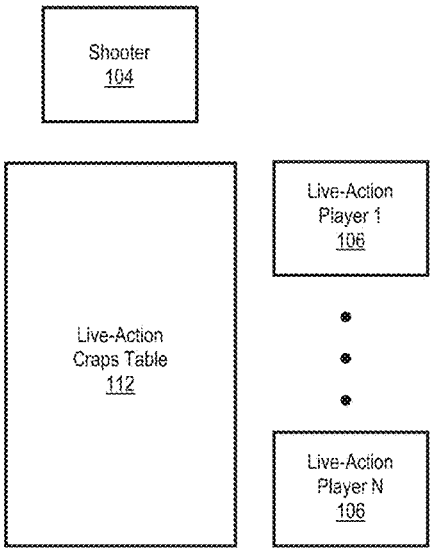
FIG. 3 is a more detailed diagram of components of the system of FIG. 1.

FIGS. 1-10 together disclose the craps table game multiplier system and method of the present invention. Referring first to FIGS. 1, 3, and 4A, an exemplary table game multiplier system 100 (thereinafter "system 100") is shown. The system 100 may be hosted on-site at a casino or any other suitable establishment where a craps table game may be played. The system 100 provides a method for one or more people (tiered players 108) who are located remotely from a physical, live-action craps table 112 to wager on any one roll or rolls of each die of a pair of dice by a player, namely a shooter 104 (aka roller), who is physically present at the live-action craps table 112 where a live-action craps table game is being played. In one embodiment, the tiered players 108 may be located in areas within a system operator 101 hosting the live-action craps table 112 but away from the live-action craps table 112 itself (e.g. in a separate area or room, such as a conference room or hotel room of the system operator 101 where the live-action craps table 112 is located). In another embodiment, as described further herein, the tiered players 108 may be located outside of the system operator 101. The tiered players 108 have no influence on the shooter 104 or the outcome of a roll of each die of the pair of dice. In the system 100, in addition to the shooter 104, other players (live-action players 106) may be physically present at the live-action craps table 112, up to as many live-action players 106 as the live-action craps table 112 can accommodate. With the system 100, each player, whether a shooter 104, live-action player 106, or a tiered player 108, may wager on any one roll of each die of the pair of dice, following the rules of play for conventional casino craps (or such other rules as may be determined by the particular system operator 101 hosting the system 100). The players present at the live-action craps table 112 may each take turns rolling the dice; accordingly, a live-action player 106 may become the shooter 104 when it is his or her urn to roll the dice. At such a time, the player who was the shooter 104 may then become a non-shooting live-action player 106 (or may elect to leave the game).

In general, the system 100 may comprise a management system 102; a live-action craps table 112 where a player or players may play the game of craps, such players including at least a shooter 104 and, optionally, additional live-action players 106 (1 through N); a tote board 144; one or more video cameras 146; a virtual chip tray server 148; a game client 158; one or more electronic telecommunication devices 160 operated by one or more tiered players 108 (1 through N); one or more tiered craps tables 162; a game server 164; a pit control 170; a video stream 172; a network 174; and administrative tools 176. The network 174 may be established to connect various components of the system 100, including the management system 102, tote board 144, video camera(s) 146, virtual chip tray server 148, game client 158, electronic telecommunication device(s) 160, tiered craps table(s) 162, game server 164, pit control 170, and video stream 172. The network 174 may be connected by wired and/or wireless means which may include, but are not limited to, cellular, satellite, local area network (LAN), wide area network (WAN), virtual private networks (VPN), or global network (e.g. Internet). The network 174 may also include Wi-Fi technology. The network 174 may also include Bluetooth wireless technology when using a smart device to communicate locally with various components in the system 100, as described further herein.

The system 100 may be hosted within the system operator 101. The system operator 101 may comprise a casino or any other suitable establishment where a craps table game may be played. According to one embodiment, the system 100 may comprise a management system 102, such as a casino management system ("CMS"), for example. The management system 102 may implement and provide communication between the other components in the system 100. Thus, the management system 102 may be configured to handle the communication aspects of the system 100. Referring to FIGS. 1 and 2, in one embodiment, the management system 102 may include or be linked to a server 103 for this purpose. In another embodiment, the system operator 101 may host a separate communications server through which communication between the various system 100 components may occur. In addition to handling the communication aspects of the system 100, the management system 102 may include various modules configured to handle various other aspects of the system operator's 101 day-to-day operations, such as accounting, reservations, membership, players' accounts, loyalty systems, marketing and promotions, system operator 101 floor management, and other system operator 101 operations.

Referring to FIGS. 1 and 2, in one embodiment, the server 103 of the management system 102 may include a processor 109 as well as memory or a database 110. The database 110 may be configured to house various data pertaining to system operator 101 operations generally and/or to the system 100. For example, database 110 may house data relating to the players (including those taking on the role of the shooter 104, live-action player(s) 106 and/or tiered player(s) 108), the live-action craps table(s) 112, and any other aspect of the system 100. With respect to data relating to the players 104, 106 and 108, the database 110 may store such information as a player's 104, 106, and 108 name, date of birth, authentication credentials (e.g. Personal Identification Number (PIN), user login, and password), contact information (e.g. phone number, address, e-mail address, etc.), credit card/debit card/bank account information, information for a player system account 178, enrollment date, photo identification (e.g. driver's license, passport, etc.), tax forms, the players' 104, 106, and 108 unique identification codes and/or identification numbers, and any other information pertaining to the players 104, 106, and 108. The database 110 may also house information regarding the amount of money that a player 104, 106, and 108 has in his or her player system account 178. The database 110 may store information regarding the balance in the player's 104, 106, and 108 player system account 178, as well as the bets that the player 104, 106, and 108 has made and the amounts and outcomes of those bets. This data may be transmitted to and analyzed by the system operator 101.

The processor 109 may be used to control the various functions pertaining to the management system 102. The processor 109 may also be used to control the various functions pertaining to various aspects of the system 100. The processor 109 may store a computer program or other programming instructions associated with the database 110. The data and structures and code within the software in which the present invention may be implemented, may typically be stored on a non-transitory computer-readable storage. The storage may be any device or medium that may store code and/or data for use by a computer system. The non-transitory computer-readable storage medium includes, but is not limited to, volatile memory, non-volatile memory, magnetic and optical storage devices such as disk drives, magnetic tape, CDs (compact discs), DVDs (digital versatile discs or digital video discs), or other media capable of storing code and/or data now known or later developed. The processor 109 may comprise various computing elements, such as integrated circuits, microcontrollers, microprocessors, programmable logic devices, etc. alone or in combination to perform the operations described herein.

Referring again to FIG. 1, according to one embodiment, the system 100 may comprise multiple servers, including the server 103 discussed above, as well as the virtual chip tray server 148 and game server 164. In this embodiment, each server 103, 148, and 164 may be dedicated to different aspects of the system 100. For example, as further discussed herein, the virtual chip tray server 148 may be dedicated to the accounting aspects of the system 100 and the game server 164 may be dedicated to the gaming aspects of the system 100. Alternatively, the system 100 may have one or more servers, wherein each server may be capable of handling all of the communication aspects, accounting aspects, and gaming aspects of the system 100. In another embodiment, the system 100 may comprise other various servers in addition to the server 103, virtual chip tray server 148 and game server 164.

Figure 5:
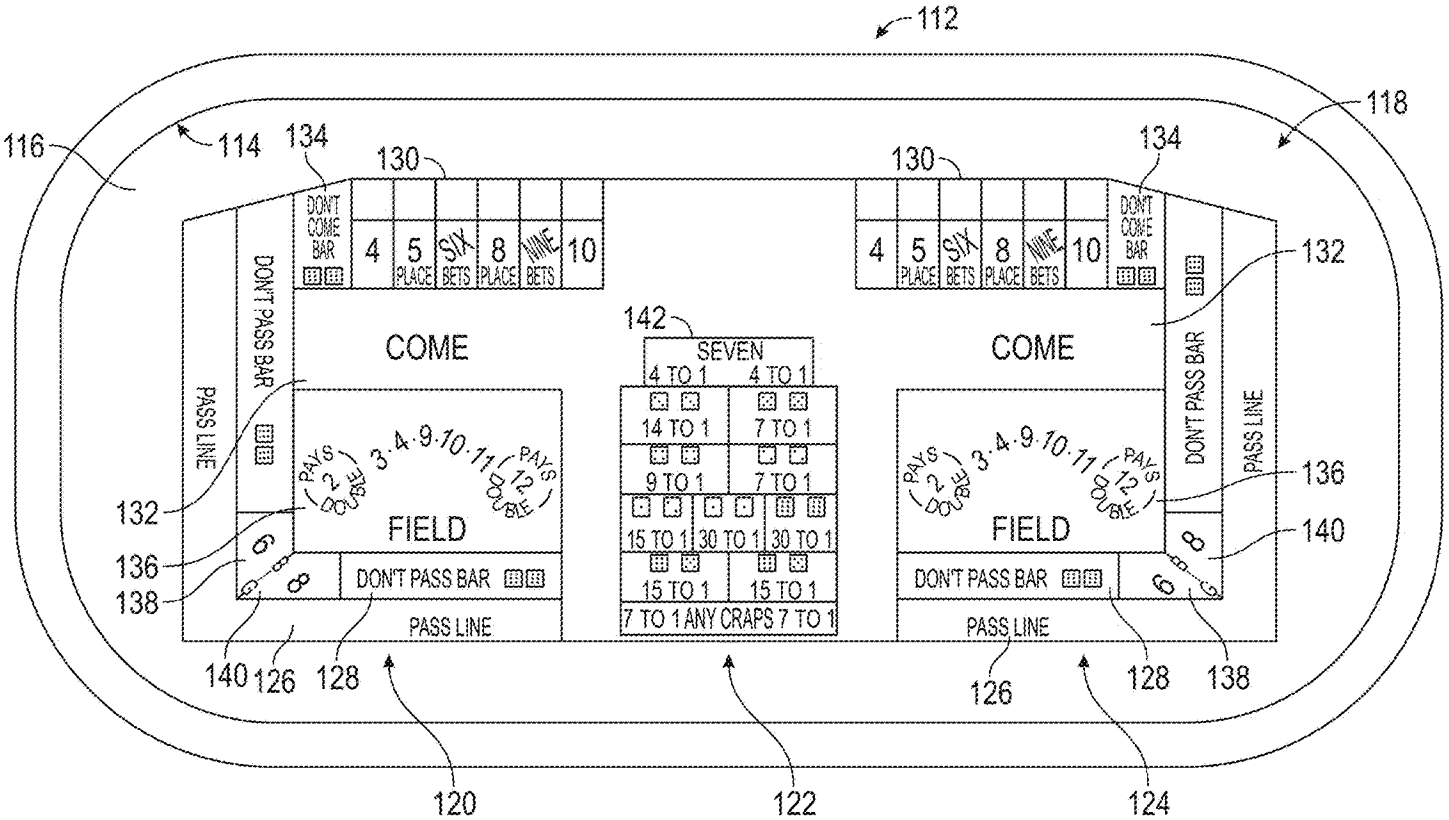
FIG. 5 is a top-plan view of an exemplary craps table.

According to one embodiment, the system 100 may comprise a live-action craps table 112 that is present within the system operator 101. The live-action craps table 112 may comprise a conventional craps table as is commonly used in casinos, such as, but not limited to, one like the exemplary craps table that is shown in FIG. 5. Referring to FIG. 5, the live-action craps table 112 may comprise a large, elongated table having a double layout 118 displayed on a felt playing surface 116. An upright sidewall 114 may surround the playing surface 116. The layout 118 may comprise a left side section 120, a center section 122, and a right side section 124, with the two side sections 120 and 124 mirroring each other. The layout 118 may provide space for the various betting options available in the game, and may also display the odds of particular rolls and/or set forth payouts for various rolls, all according to the rules of conventional casino craps (or as may otherwise be determined by the particular system operator 101). Thus, the layout 118 may comprise a pass line area 126, a don't pass bar 128, a point number area 130, a come area 132, a don't come bar 134, a field area 136, a big 6 area 138, a big 8 area 140, and a proposition bet area 142. The live-action craps table 112 may be staffed by a table crew comprising at least four personnel of the system operator 101. For example, the table crew may include a boxman, a stickman, and two dealers. However, it may be possible for the live-action craps table 112 to be staffed by more than four or less than four system operator 101 personnel, depending on the number of live-action players 106 that may be present at the live-action craps table 112 at any given time and/or the needs of the particular system operator 101. Referring to FIG. 3, the live-action craps table 112 may be configured to accommodate a shooter 104 and one or more live-action players 106.

In the system 100, the live-action craps table 112 is the only table where there is a shooter 104 who rolls the dice. At the live-action craps table 112, each player, whether a shooter 104 or live-action player 106 may be identified and may place bets in the live-action craps table game. Further, each player at the live-action craps table 112, whether a shooter 104 or live-action player 106, may be identified, within a tiered craps game, as to his or her bets placed at the live-action craps table 112. According to one embodiment, the system 100 may also comprise a plurality (not shown) of live-action craps tables 112. Each live-action craps table 112 may therefore be assigned a unique identifier, such as a name or identification code, so that they may be easily identified within the system 100. With respect to placing bets, the shooter 104 and live-action players 106 may use any acceptable payment method to place a bet at the live-action craps table 112, such as, but not limited to, cash, a player system account 178, or tokens. The tiered players 108 use their player system account 178 to place their bets.

Referring again to FIG. 1, the results of each roll of each die of the pair of dice at the live-action craps table 112 may be displayed electronically. An electronic tote board 144 may be utilized for this purpose. The tote board 144 may comprise a tote board similar to those commonly utilized at casinos (such as at roulette tables, for example), but specially configured to display the results of each roll of each die of the pair of dice in a game of craps. The tote board 144 may be controlled electronically by the pit control 170, as discussed further herein.

Figure 6:
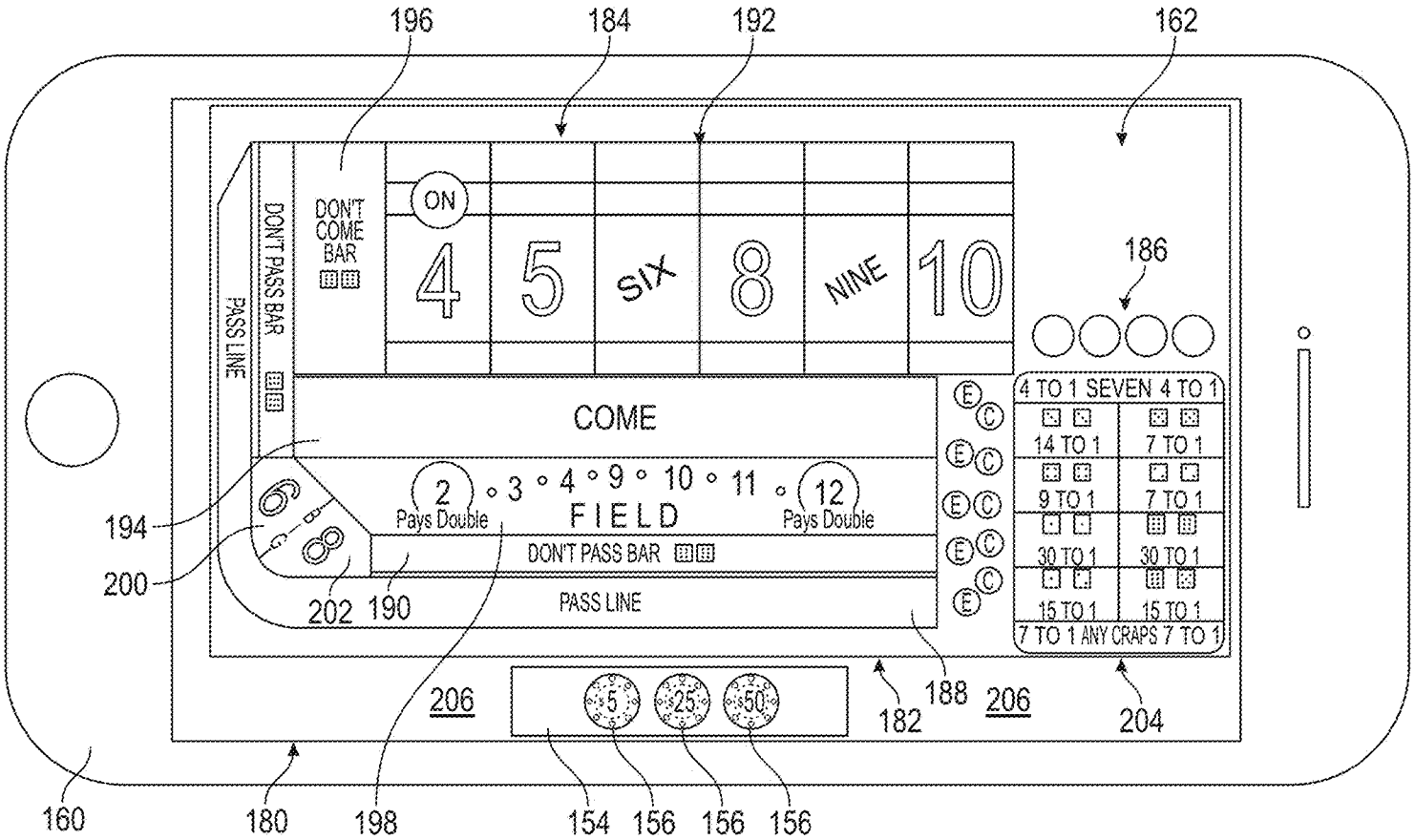
FIG. 6 is a top-plan view of an exemplary virtual craps table layout, including exemplary virtual chips, as they could appear on an exemplary electronic telecommunication device according to one or more aspects of the present invention.

Referring still to FIG. 1, the virtual chip tray server 148 will be discussed. The virtual chip tray server 148 is a secure currency transaction server that may be utilized for selling and redeeming virtual casino chips. The virtual chip tray server 148 may have a processor 150 as well as a memory or database 152. The database 152 may host a data source, including data relating to a virtual chip tray 154 (as shown in FIG. 6) utilized by a tiered player 108. The virtual chip tray server 148 may comprise an e-commerce component that allows tiered players 108 to purchase virtual chips 156 (as shown in FIG. 6) with which to place bets on tiered craps games by utilizing the game client 158 (as discussed further herein). In this regard, the virtual chip tray server 148 may be configured to process e-commerce transactions through which tiered players 108 may purchase their virtual chips 156. With the virtual chip tray 154 data residing on the virtual chip tray server 148, the virtual chip tray 154 data cannot be accessed directly by a player; rather the virtual chip tray 154 data may only be accessed by the game client 158. This helps to ensure the security of the virtual chip tray 154 data. Through the virtual chip tray server 148, tiered players 108 may cash out their winnings at the conclusion of playing a tiered craps game.

The processor 150 may be used to control the various functions pertaining to the virtual chip tray 154. Such functions may include, but not be limited to, payment transactions initiated by tiered players 108 to purchase virtual chips 156 for their virtual chip trays 154. Such payment transactions may be made through the tiered players' 108 player system accounts 178, which may be linked to the virtual chip tray server 148 via network 174. Another function pertaining to the virtual chip tray 154 may include, but not be limited to, payment transactions made by the system operator 101 to make payouts to tiered players 108 of their winnings. Additional functions pertaining to the virtual chip tray 154 may also be performed, as appropriate. The processor 150 may be implemented in hardware, software, or a combination thereof. The processor 150 may store a computer program or other programming instructions associated with the database 152 to control the operations of the virtual chip tray 154. The data and structures and code within the software in which the present invention may be implemented may typically be stored on a non-transitory computer-readable storage. The storage may be any device or medium that may store code and/or data for use by a computer system. The non-transitory computer-readable storage medium includes, but is not limited to, volatile memory, non-volatile memory, magnetic and optical storage devices such as disk drives, magnetic tape, CDs (compact discs), DVDs (digital versatile discs or digital video discs), or other media capable of storing code and/or data now known or later developed. The processor 150 may comprise various computing elements, such as integrated circuits, microcontrollers, microprocessors, programmable logic devices, etc. alone or in combination to perform the operations described herein.

Figure 4A:
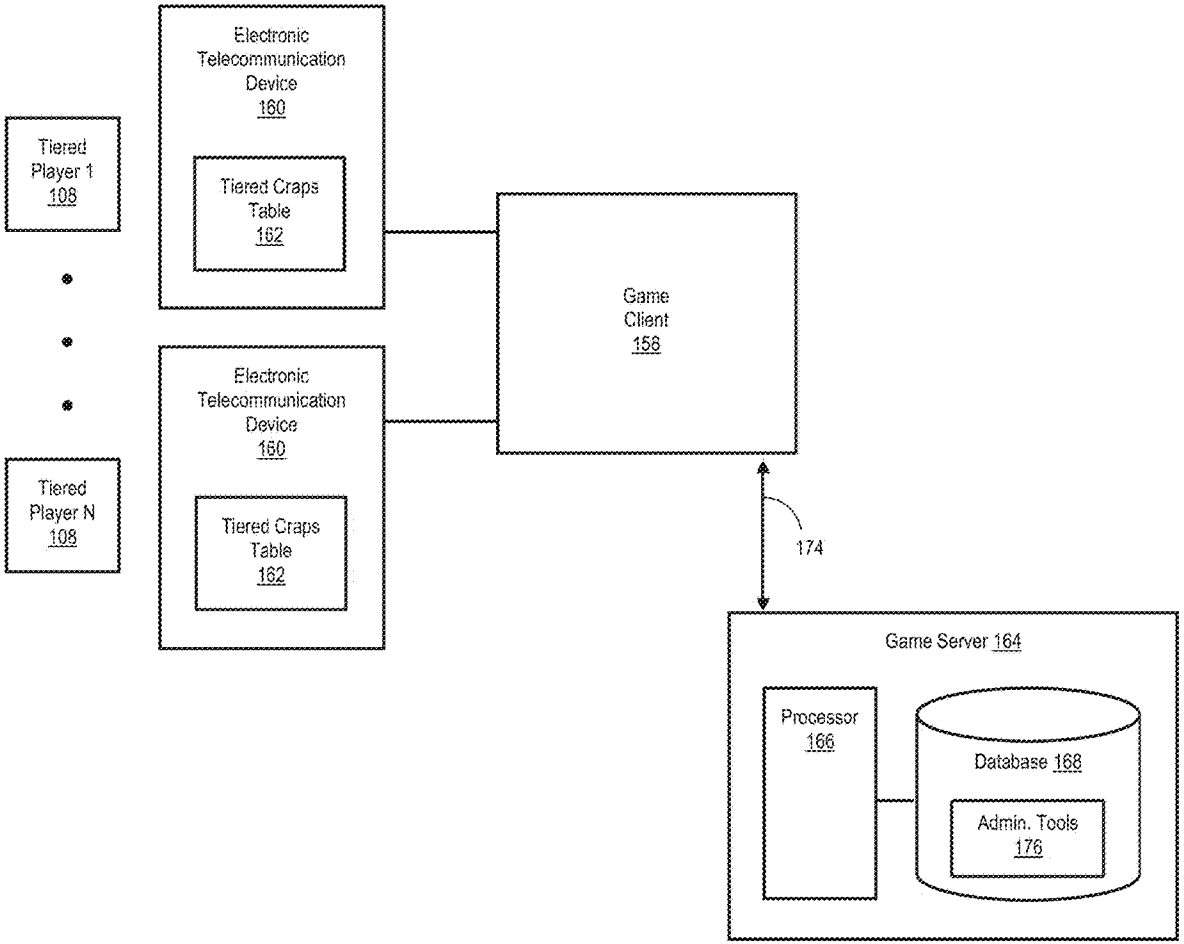
FIG. 4A is a more detailed diagram of components of the system of FIG. 1.
Figure 4B:
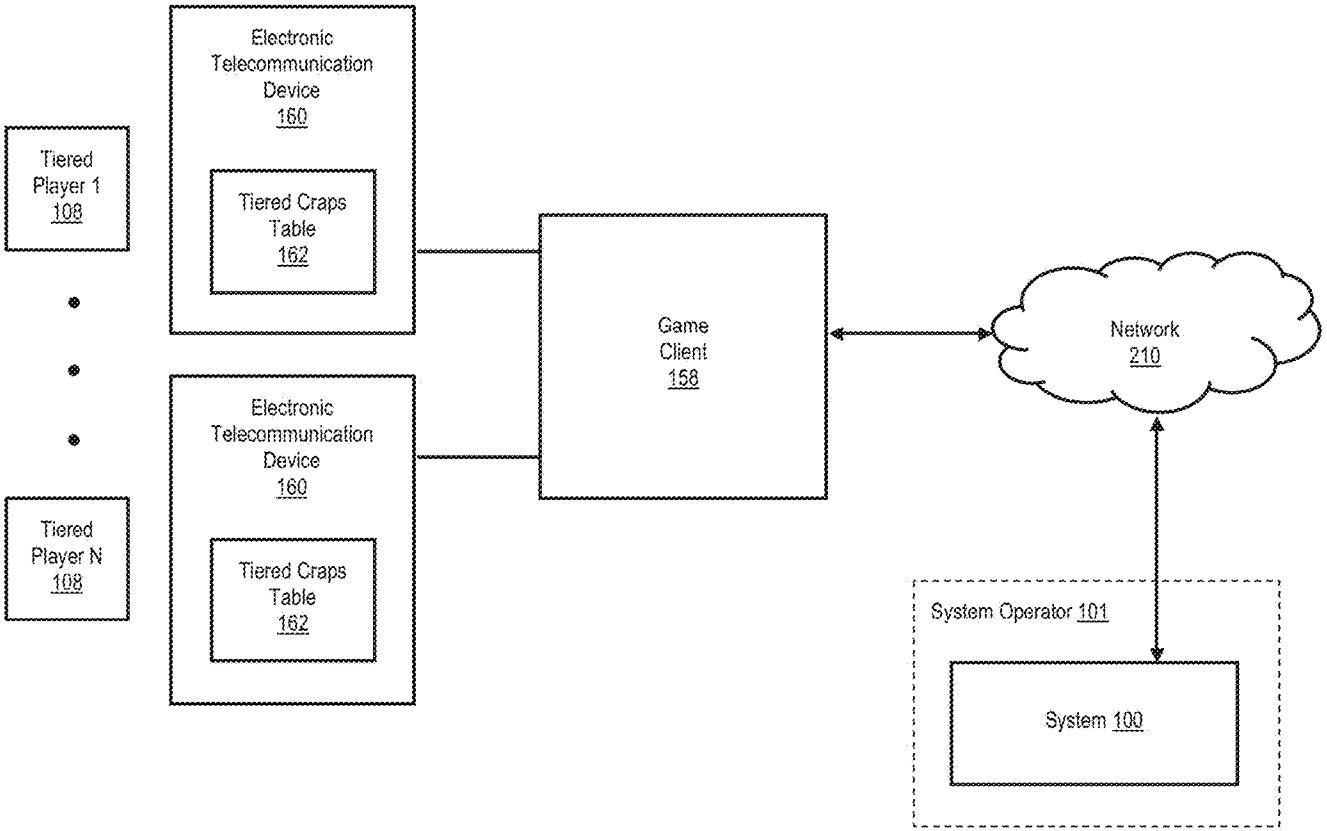
FIG. 4B is a block diagram of components of an exemplary table game multiplier system according to one or more aspects of the present invention.

Referring now to FIGS. 1 and 4A, the game client 158 will be discussed. This component of the system 100 connects a tiered player(s) 108 to the game server 164. The game client 158 may comprise application software configured to run on an electronic telecommunication device 160 operated by a tiered player 108. In this embodiment, the tiered player 108 and the electronic telecommunication device 160 are physically present within the system operator 101. In this embodiment, the game client 158 connects the tiered player 108 to the game server 164 via network 174. According to another embodiment, as shown in FIG. 4B the tiered player 108 and the electronic telecommunication device 160 are located outside of the system operator 101. In this embodiment, the game client 158 may first connect to the system operator 101 via a network 210, such as the Internet, in order to connect to the system 100 and, in turn, the game server 164. When utilizing the system 100, it would be possible to have a situation in which some tiered players 108 operating electronic telecommunication devices 160 are located within the system operator 101 and other tiered players 108 operating electronic telecommunication devices 160 are located outside the system operator 101 simultaneously.

The electronic telecommunication device 160 may be a smartphone, a tablet computer, iPad®), a personal computer, or any other smart device or suitable electronic telecommunication device having a graphical user interface and capable of transmitting and receiving data via service provided by a cellular phone carrier or internet service provider and/or via Wi-Fi and/or Bluetooth wireless technology. The electronic telecommunication device 160 may be configured with various operating systems including, but not limited to, Apple iOS, Android, and Microsoft Windows Mobile operating systems, or other various suitable operating systems. The electronic telecommunication device 160 may be configured with a touch sensitive screen. Further, the electronic telecommunication device 160 may be configured with a video screen suitable for displaying a tiered craps table 162 as well as a video stream 172 showing video of the live-action craps table 112 (as further discussed herein). While, in one embodiment, the electronic telecommunication device 160 may be configured as a wireless device, it should generally be understood that substantial benefit could be derived from an embodiment of the present invention wherein the electronic telecommunication device 160 is configured as a wired device.

According to one embodiment, the game client 158 may be configured for an Android-enabled device or other suitable electronic telecommunication device and/or gaming device (e.g. a handheld gaming device or a gaming terminal) residing within the system operator 101. In this embodiment, the Android-enabled device or other suitable electronic telecommunication device and/or gaming device may utilize a touch sensitive screen. Further, in this embodiment, the game client 158 may utilize a closed application.

According to one embodiment, each tiered player 108 may utilize the game client 158 on a separate electronic telecommunication device 160. Each tiered player 108 may utilize his or her own personal electronic telecommunication device 160 for this purpose. Alternatively, tiered players 108 may utilize any suitable electronic telecommunication device 160 and/or gaming device residing within the system operator 101, such as, for example, a handheld gaming device or a gaming terminal provided by the system operator 101. Thus, the system 100 may comprise one or more electronic telecommunication devices 160, depending upon the number of tiered players 108 involved at any given time.

The game client 158 may be configured to host a tiered craps table 162 that tiered players 108 may view and interact with (as discussed further herein) on their respective electronic telecommunication devices 160. The tiered craps table 162 may be a virtual representation of all or a portion of the layout 118 of the live-action craps table 112, such that the tiered craps table 162 is a virtual duplicate of the live-action craps table 112. The tiered craps table 162 facilitates the play of a tiered craps game that is based on the same live-action craps table game being played at the live-action craps table 112, and may be played by tiered players 108 on their respective electronic telecommunication devices 160.

Referring to FIG. 6, the tiered craps table 162 may be displayed on a graphic user interface of the electronic telecommunication device 160 as part of a main game screen 180. In this embodiment, the display of the tiered craps table 162 may comprise half of a standard craps table layout. In this regard, the tiered craps table 162 may include a layout 182 comprising a left side section 184 and center section 186 of a craps table or, alternatively, a right side section (similar to the right side section 124 of the live-action craps table 112 depicted in FIG. 5) and a center section 186 of a craps table (since each player in a conventional craps game utilizes only one side section 120 or 124 of a live-action craps table 112 at any given time). In another embodiment (not shown), the display of the tiered craps table 162 may include a layout comprising a full craps table having a left side section, center section, and right side section. The layout 182 may provide space for the various betting options available in the game, and may also display the odds of particular rolls and/or set forth payouts for various rolls, all according to the rules of conventional casino craps (or as may otherwise be determined by the particular system operator 101). Thus, the layout 182 may comprise a pass line area 188, a don't pass bar 190, a point number area 192, a come area 194, a don't come bar 196, a field area 198, a big 6 area 200, a big 8 area 202, and a proposition bet area 204. In addition to the tiered craps table 162, other items may be displayed on the main game screen 180 including, but not limited to, a representation of the virtual chip tray 154 which may display the tiered player's 108 virtual chips 156 utilized in the particular tiered game. In addition, the main game screen 180 may include regions 206 that may be designated for various purposes, including displaying other items useful to the individual tiered player(s) 108 playing the tiered craps game, such as the tiered player's 108 current total bet amount, the outcome of a roll of each die of the pair of dice, the total amount won as a result of a winning bet, and/or the total value/balance of the tiered player's 108 remaining virtual chips 156, for example.

Referring again to FIG. 1, in addition to communicating with the game server 164, the game client 158 also communicates with the virtual chip tray server 148 via network 174. Through this connection, a tiered player 108 may purchase virtual chips 156 for use in a tiered craps game, as discussed herein.

By utilizing the game client 158 on the electronic telecommunication device 160, a tiered player 108 may play a tiered craps game. In this regard, a tiered player 108 utilizing the game client 158 may bet on any roll of each die of the pair of dice performed by the shooter 104 at the live-action craps table 112. (The tiered craps table 162 does not have a shooter 104. Rather, as discussed above, only the live-action craps table 112 has a shooter 104 who rolls the dice. Thus, the results of all bets made by tiered players 108 are determined by a roll of each die of the pair of dice made by the shooter 104 at the live-action craps table 112.) According to one embodiment, all bets made by tiered players 108 may be placed electronically through the game client 158. Once a tiered player 108 places a bet and such action is communicated over network 174 to the system operator 101, the system operator 101 may then electronically place the tiered player's 108 bet on the tiered craps table 162 at which the tiered player 108 is playing and/or for which the tiered player 108 is signed in. All bets of tiered players 108 playing at tiered craps tables 162 may be identified electronically, as further discussed herein.

According to one embodiment, all action occurring on the tiered craps table 162 may be based on the same odds and payouts as the action occurring on the live-action craps table 112. In this embodiment, all tiered craps tables 162 may be electronically preprogrammed with odds identical to those of the live-action craps table 112. Alternatively, all action on the tiered craps table 162 may be based on particular odds and payouts as may be determined by the particular casino. According to one embodiment, multiple tiered craps tables 162 may be utilized within the system 100 at any given time, depending on the number of tiered players 108 involved and/or the number of social groups created for tiered craps games. In order to keep track of each tiered craps table 162 within the system 100, a unique identification code or identification number may be assigned to each tiered craps table 162.

Referring now to the game server 164, this component of the system 100 serves as the intermediary piece between the physical, live-action craps table 112 and the game client 158. Referring to FIGS. 1 and 4, the game server 164 may have a processor 166 as well as a memory or database 168. The database 168 may store data relating to various aspects of tiered craps games including, but not limited to: data relating to the players, such as identification codes and/or numbers associated with each tiered player 108, shooter 104, and live-action player 106; data relating to the craps tables, s as identification codes and/or numbers associated with each tiered craps table 162 and live-action craps table 112, and data regarding each roll of each die of the pair of dice performed on/occurring at the live-action craps table 112; and data relating to each bet/wager made by each tiered player 108.

The game server 164 may process, via processor 166, various data transactions and transmit the data to the game client 158. For example, the game server 164 may transmit data to the game client 158 regarding the action occurring at the live-action craps table 112. In this way, the game server 164 instructs the game client 158 to update the main game screen 180 in real time, so that the main game screen 180 accurately displays a virtual representation of the action occurring at the live-action craps table 112 at any given time.

The game server 164 may process, via processor 166, various input received from each tiered player 108. For example, the game server 164 may track the bets/wagers coming from all of the tiered players 108 who utilize the game client 158 on their respective electronic telecommunication devices 160. With the bets/wagers being tracked in this manner, the system 100 is able to keep track of all bets placed by tiered players 108. According to one embodiment, the data regarding the bets/wagers tracked by the game server 164 may be electronically recorded, such as in audit logs, for example. The audit logs may include such information as the date and time that a tiered player 108 logged in to the system 100, the unique identifier associated with the tiered player 108, each particular bet made by the tiered player 108, the amount of each particular bet made by the tiered player 108, and the date and time that each particular bet was made by the tiered player 108. The audit logs may be stored within the system 100, such as in database 110 and/or database 168, or in such other area or areas of the system 100 as may be appropriate. In this way, the audit logs may be utilized by system operator 101 personnel or other authorized personnel as may be needed in particular instances, such as for dispute resolution, for example.

At the live-action craps table 112, a system operator 101 employee or other authorized person electronically registers the result of each roll of each die of the pair of dice (as described further herein). The result of each roll of each die of the pair of dice may then be electronically communicated from the pit control 170 to the tote board 144 at the live-action craps table 112 via network 174 and to the game server 164, also via network 174. Once the result of each roll of each die of the pair of dice is communicated to the game server 164, multiple events are triggered. In this regard, the game server 164 may then process, via processor 166, the data regarding the outcome of the roll, and transmit that data to the game client 158. In addition, the game server 164 may instruct the game client 158 to update the main game screen 180 in real time, so that the main game screen 180 accurately displays a virtual representation of the live-action craps table 112, which may include the outcome of the roll. Further, once the result of each roll of each die of the pair of dice is communicated to the game server 164, a determination can then be made at the game server 164 as to whether each tiered player 108 won, lost, or had a "no action" on the particular roll. The logic regarding the determination as to whether each tiered player 108 won, lost, or had a "no action" may then be communicated to each game client 158 via network 174 to inform each tiered player 108 as to whether he or she won, lost, or had a "no action" on the particular roll. Thus, in addition to receiving and processing various input from each tiered player 108, the game server 164 may also receive and process input from the pit control 170.

The processor 166 may store a computer program or other programming instructions associated with the database 168. The data and structures and code within the software in which the present invention may be implemented, may typically be stored on a non-transitory computer-readable storage. The storage may be any device or medium that may store code and/or data for use by a computer system. The non-transitory computer-readable storage medium includes, but is not limited to, volatile memory, non-volatile memory, magnetic and optical storage devices such as disk drives, magnetic tape, CDs (compact discs), DVDs (digital versatile discs or digital video discs), or other media capable of storing code and/or data now known or later developed. The processor 166 may comprise various computing elements, such as integrated circuits, microcontrollers, microprocessors, programmable logic devices, etc. alone or in combination to perform the operations described herein.

Referring again to FIG. 1, the pit control 170 will be discussed. This component of the system 100 communicates with the game server 164 and the tote board 144. The pit control 170 provides the game server 164 and tote board 144 with the outcome of each roll of each die of the pair of dice. The pit control 170 may comprise an electronic telecommunication device configured to run application software specially configured for entering into the system 100 the outcome of rolls of each die of the pair of dice as they occur at the live-action craps table 112. The electronic telecommunication device may be a Wi-Fi enabled electronic telecommunication device, such as a smartphone, tablet computer (e.g. iPad®), a personal computer, or any other smart device or suitable electronic telecommunication device having a graphical user interface and capable of transmitting and receiving data via service provided by a cellular phone carrier or internet service provider and/or via Bluetooth wireless technology. The pit control 170 may be configured with a touch sensitive screen. While, in one embodiment, the pit control 170 may be configured as a wireless device, it should generally be understood that substantial benefit could be derived from an embodiment of the present invention wherein the pit control 170 is configured as a wired device. The pit control 170 may be operated by a system operator 101 employee (e.g. croupier) who, by utilizing the application software, enters the results of each roll of each die of the pair of dice. With the results of each roll of each die of the pair of dice being entered in this manner, the system 100 is able to keep track of all rolls of each die of the pair of dice. In one embodiment, a record of each roll of each die of the pair of dice may be maintained on the game server 164 and stored and/or archived on database 168. After entering the results of a roll of each die of the pair of dice, the results may then be communicated electronically from the pit control 170 to the tote board 144 (where they will be displayed to the shooter 104, live-action players 106, and others who may be physically present at the live-action craps table 112) and to the game server 164, via network 174. The game server 164 may then, in turn, communicate the results to the game client 158 (where they will be displayed to tiered players 108 utilizing the game client 158 on their respective electronic telecommunication devices 160), also via network 174. According to one embodiment, network 174 may be configured with a secure connection between the pit control 170 and the game server 164. Additionally, network 174 may be configured with a secure connection between/among other components of the system 100.

The system 100 may comprise a video stream 172. In one embodiment, video generated by one or more live video cameras 146 recording the live-action craps table 112 may supply a video feed for the video stream 172. The video stream 172 may be broadcast via network 174 to various components in the system 100 utilizing known video broadcasting protocols. The video stream 172 may include live video taken of the live-action craps table 112 before, during, and/or after a live-action craps table game. As shown in FIG. 1, the video stream 172 may be broadcast to the game client 158, where it may be displayed to the tiered players 108 on their respective electronic telecommunication devices 160. This embodiment is particularly well-suited for situations in which the electronic telecommunication devices 160 and tiered players 108 operating the electronic telecommunication devices 160 are located within the system operator 101, wherein the video stream 172 may be displayed efficiently. This is in contrast to situations in which the electronic telecommunication devices 160 and tiered players 108 operating the electronic telecommunication devices 160 are located outside the system operator 101 (see FIG. 4B), wherein there may be limited bandwidth available for efficiently displaying the video stream 172 on the game clients 158, resulting in buffering problems. Thus, in situations where the electronic telecommunication devices 160 and tiered players 108 operating the electronic telecommunication devices 160 are located outside the system operator 101, it is preferred to provide a virtual representation of the live-action craps table 112 on the electronic telecommunication devices 160. However, it would be possible to display the video stream 172 on an electronic telecommunication devices 160 located outside of the system operator 101 in situations where sufficient bandwidth is available.

Further, the video stream 172 may be broadcast on a television station or an internet website. Further still, the video stream 172 may be broadcast on an application directly to a tiered player's 108 electronic telecommunication device 160. The video stream 172 may be broadcast to various areas of the system operator 101 via the management system 102. In one embodiment, video screens configured to display the video stream 172 may be installed in the system operator 101 for viewing by system operator 101 personnel and/or for the benefit of tiered players 108 and others present at the system operator 101. The video stream 172 may also be broadcast to any other suitable device capable of receiving a live stream broadcast. With video from the live-action craps table 112 being broadcast in this manner, a tiered craps game may also be played in virtual reality from a broadcast of the live-action craps table 112 (as further discussed herein).

According to one embodiment, the video stream 172 may be broadcast on a television station. In this embodiment, tiered players 108 may register for a tiered craps game through application software and, utilizing such application software, place their respective wagers for the tiered craps game. In one embodiment, wagers may be placed by voice utilizing known voice-recognition technology. Once a tiered player 108 places his or her wager, the wager may be posted on a screen for the tiered player 108 to see. Such a screen may also include other information, such as information pertaining to the tiered player's 108 player system account 178, for example (e.g. total funds available in the player system account 178). Immediately after each completed roll, the tiered player's 108 player system account 178 would be debited or credited accordingly.

According to one embodiment, the video stream 172 may be broadcast on an internet website. In this embodiment, this may allow tiered players 108 to register for a tiered craps game through application software and, utilizing such application software, choose a desired live-action craps table 112 from among an offering of various system operators 101 providing live-action craps table games and then play a tiered craps game at the selected system operator 101.

According to one embodiment, the video generated by the live video cameras 146 recording the live-action craps table 112 may be stored and/or archived within the system 100, such as by storing and/or archiving on database 110 or on some other suitable database or storage medium. In this way, such video may be viewed thereafter by system operator 101 personnel or other authorized personnel if needed in particular instances, such as for dispute resolution or for security purposes, for example.

Referring now to the administrative tools 176, these may comprise various system and/or network tools, such as tools for managing, maintaining, and setting preferences within the system 100 and/or the various components therein, and the like. The administrative tools 176 may be set up for use by system operator 101 personnel, technicians, and/or any other authorized personnel. Referring again to FIG. 4A, in one embodiment, the administrative tools 176 may reside on the game server 164. Alternatively, the administrative tools 176 may reside in one or more other suitable locations within the system 100.

According to one embodiment of the system 100, each tiered player 108 may be identified according to various parameters. For example, the system 100 may require that each tiered player 108 undergo an enrollment process wherein particular information regarding each tiered player 108 is provided to the casino and recorded. Such information may include, but not be limited to, each tiered player's 108 date of birth and address. Each tiered player 108 may be required to supply his or her driver's license in order to provide proof of such information to the system operator 101 and/or to provide photo identification to the system operator 101. Each tiered player 108 may also be assigned a unique identifier by the system operator 101, such as an identification code or identification number, so that he or she may be easily identified within the system 100. With each tiered player 108 being identified, such information may be utilized in various ways, and each tiered player 108 may be tracked within the system 100. For example, each tiered player 108 may be identified as to his or her bets placed in a particular tiered craps game. As another example, each tiered player 108 may be scored as to his or her craps playing winning percentage.

According to one embodiment, in order to play tiered craps games, each tiered player 108 would be required to establish a player system account 178 with the system operator 101 where the live-action craps table game and associated tiered craps game are played. According to another embodiment, each tiered player 108 would be required to establish a central account where the system operator 101 draws cash. In one embodiment, data pertaining to each tiered player's 108 player system account 178 may be stored on database 110. Additionally or alternatively, data pertaining to each tiered player's 108 player system account 178 may be stored on database 152, or in another suitable, secure location within the system 100. The system operator 101 may issue a tiered player 108 a line of credit, which may be used to fund the tiered player's 108 player system account 178. Once a tiered player's 108 player system account 178 has sufficient funds, a tiered player 108 would be able to place wagers on tiered craps games. Each wager may be identified electronically by a unique registered electronic number tied to the tiered player's 108 player system account 178, so that it may be easily identified and tracked within the system 100. Tiered players 108 would be required to follow all applicable rules pertaining to their player system accounts 178, as may be established by the system operator 101.

When utilizing the system 100, the wagers of tiered players 108 may be placed through game client 158 by utilizing electronic telecommunication devices 160. In this regard, at the beginning of play, a tiered player 108 may indicate the type bet that he or she wishes to place via the game client 158. Before the shooter 104 has made an initial roll of the dice (i.e., the "come out" roll), a tiered player 108 may indicate that he or she wishes to place an allowed bet. To do so, the tiered player 108 would place a virtual chip(s) 156 (or other suitable electronic marker) directly on the appropriate section of the layout 182 of the tiered craps table 162 appearing on the main game screen 180 of the tiered player's 108 electronic telecommunication device 160, depending on the type of bet that the tiered player 108 desires to make. For example, if the tiered player 108 desires to place a "pass line" bet, the tiered player 108 would place a virtual chips) 156 on the pass line area 188 of the tiered craps table 162. Once the shooter 104 has completed his or her come out roll, tiered players 108 may wager on the various other betting options available (according to the rules of conventional casino craps, for example) by placing virtual chips 156 directly on the appropriate section of the layout 182 of the tiered craps table 162 appearing on the main game screen 180 of the electronic telecommunication device 160, depending on the type of bet that the tiered player 108 desires to make. The game client 158 would then communicate this information to the system operator 101 via network 174. Once each roll of each die of the pair of dice has been completed, tiered players 108 with winning bets may be paid immediately by electronically crediting their player system accounts 178. In addition, once each roll of each die of the pair of dice has been completed, the player system accounts 178 of tiered players 108 with losing bets may be immediately electronically debited. If a roll continues, a tiered player's 108 player system account 178 may be debited until the roll is completed, following the rules of play for conventional casino craps (or as otherwise may be determined by the particular system operator 101). Tiered players 108 may also continue to make wagers, all according to the rules of play for conventional casino craps (or as otherwise may be determined by the particular system operator 101). For example, as is standard in conventional casino craps, for individuals playing at the live-action craps table 112 (including the shooter 104 and any live-action players 106), once the dice are given to the shooter 104, no more bets can be placed at the live-action craps table 112. This standard/rule may also be implemented in different ways for tiered players 108 playing tiered craps tables 162. For example, wagers may be allowed until notice is given electronically by the system operator 101 via the game server 164 and through network 174, at which time the ability to place an electronic bet may be closed and no further electronic bets would be accepted. In the event that the system operator 101 fails to give such notice that electronic bets are closed (i.e., notice of "no more bets"), various fail-safes may be implemented to ensure that electronic bets from tiered players' 108 are closed at the appropriate time (e.g. once the dice are given to the shooter 104) or example, according to one embodiment, the game server 164 may incorporate a timer requiring tiered players 108 to place their bets within a predetermined period of time such as within thirty seconds or such other period of time as may be appropriate. Once the predetermined period of time expires, no more electronic bets would be accepted. As another example, according to another embodiment, no electronic bets are accepted until such time that the system operator 101 gives notice of "no more bets." In other words, upon the system operator 101 giving notice of "no more bets," all electronic bets made by tiered players 108 are accepted and no further electronic bets are allowed. According to one embodiment, tiered players 108 may bet or change their bets with each roll and may bet in accordance with the minimum and maximum rules established by the system operator 101.

Figure 7A:
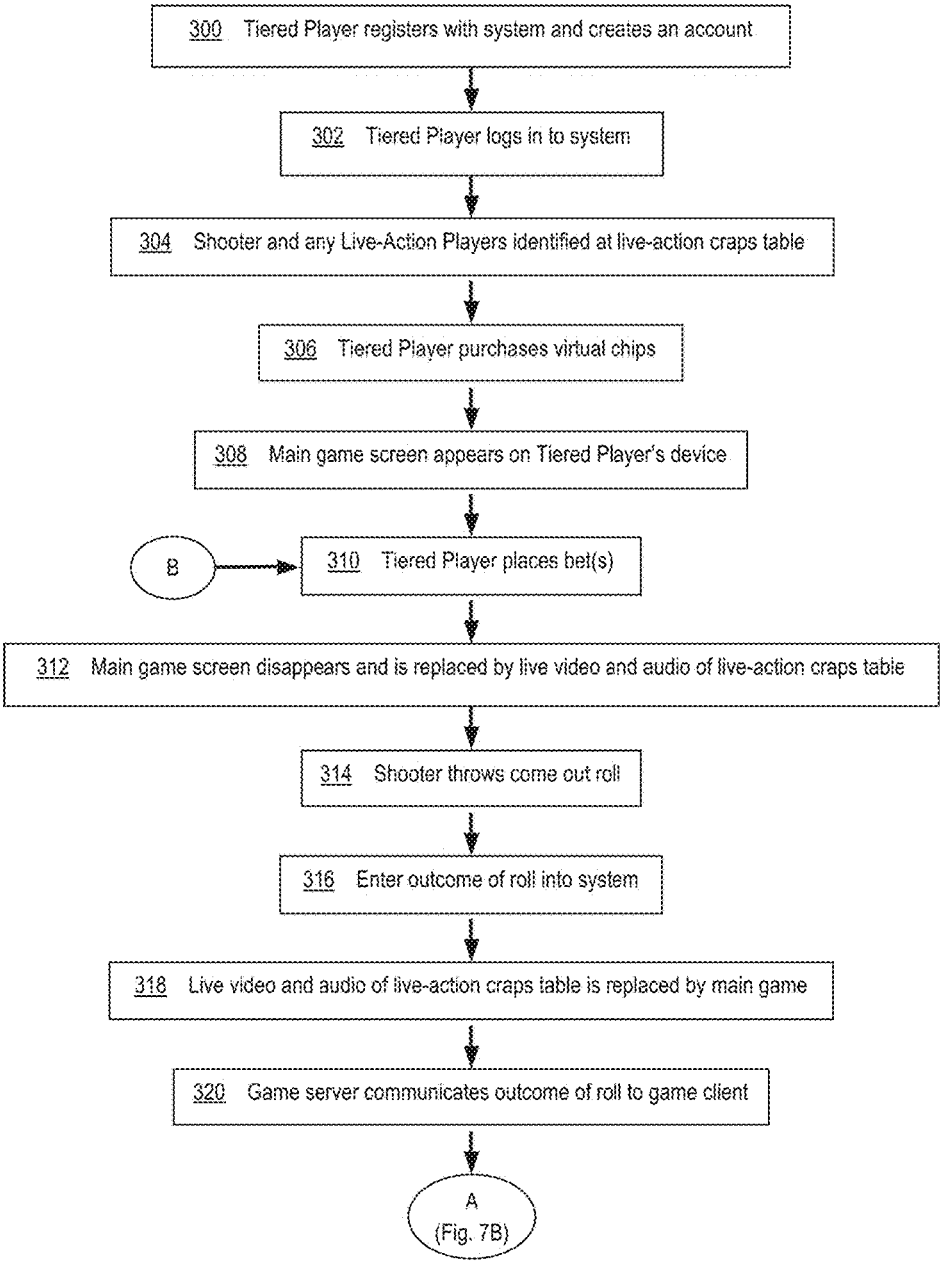
FIGS. 7A and 7B, taken together, are an exemplary flow chart depicting a method for allowing tiered players to place wagers on the outcome of at least one roll of each die of a pair of dice occurring during a live-action craps table game at a live-action craps table according to one or more aspects of the present invention.
Figure 7B:
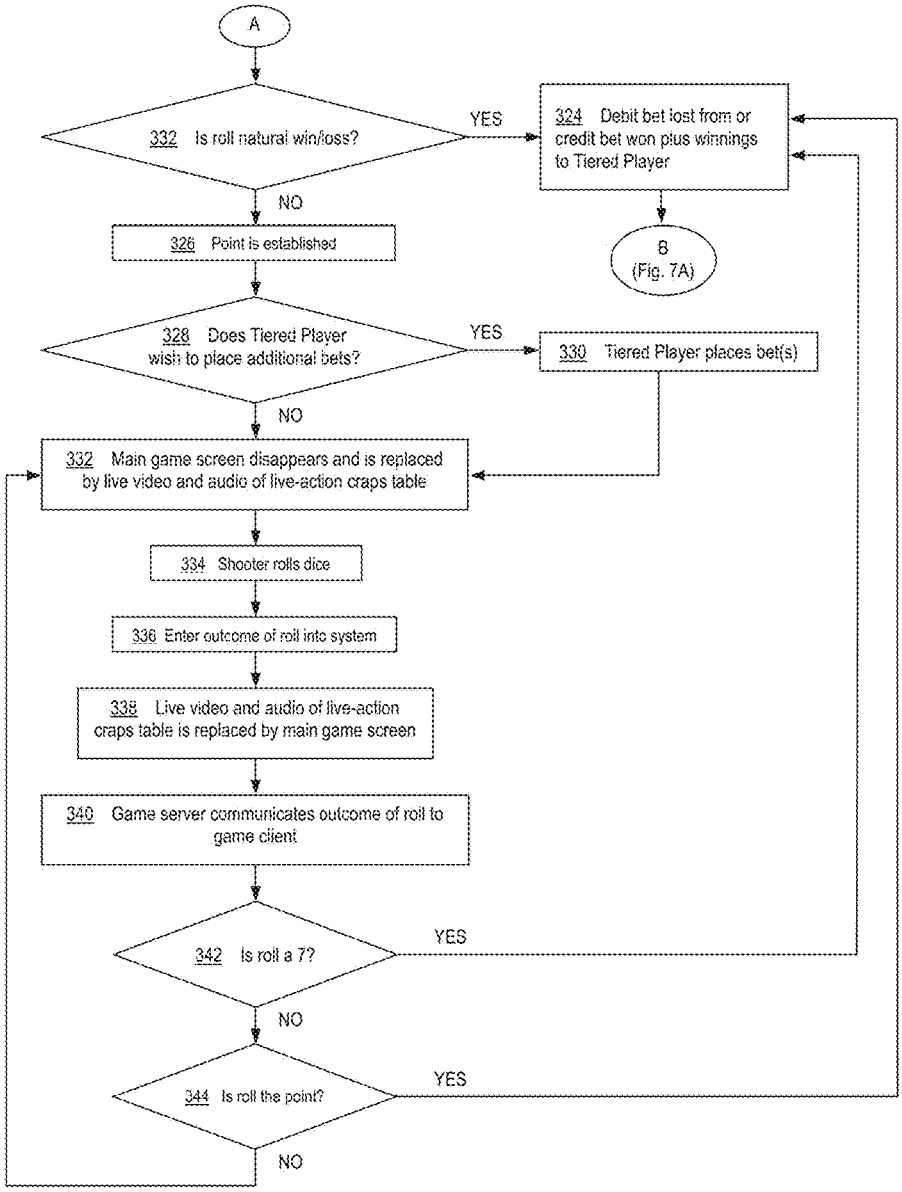

Referring now to FIGS. 7A-7B, a flowchart providing an exemplary embodiment of a method according to the present invention is shown. At step 300, a tiered player 108 may enroll with the system operator 101 in order to be able to utilize aspects of the system 100 and play tiered craps games. During the enrollment process, the system operator 101 verifies the identity of each tiered player 108 and collects any required personal information about the tiered player 108. This includes, but is not limited to, verifying the age and residency of the tiered player 108, in order to confirm that the tiered player 108 is of legal gambling age according to the laws of the applicable jurisdiction, and that the tiered player 108 resides in a locale where he or she is legally permitted to engage in gaming activity with the system operator 101. The enrollment process may be preformed in person at the system operator 101 or remotely, depending upon the laws of the applicable jurisdiction.

Figure 8:
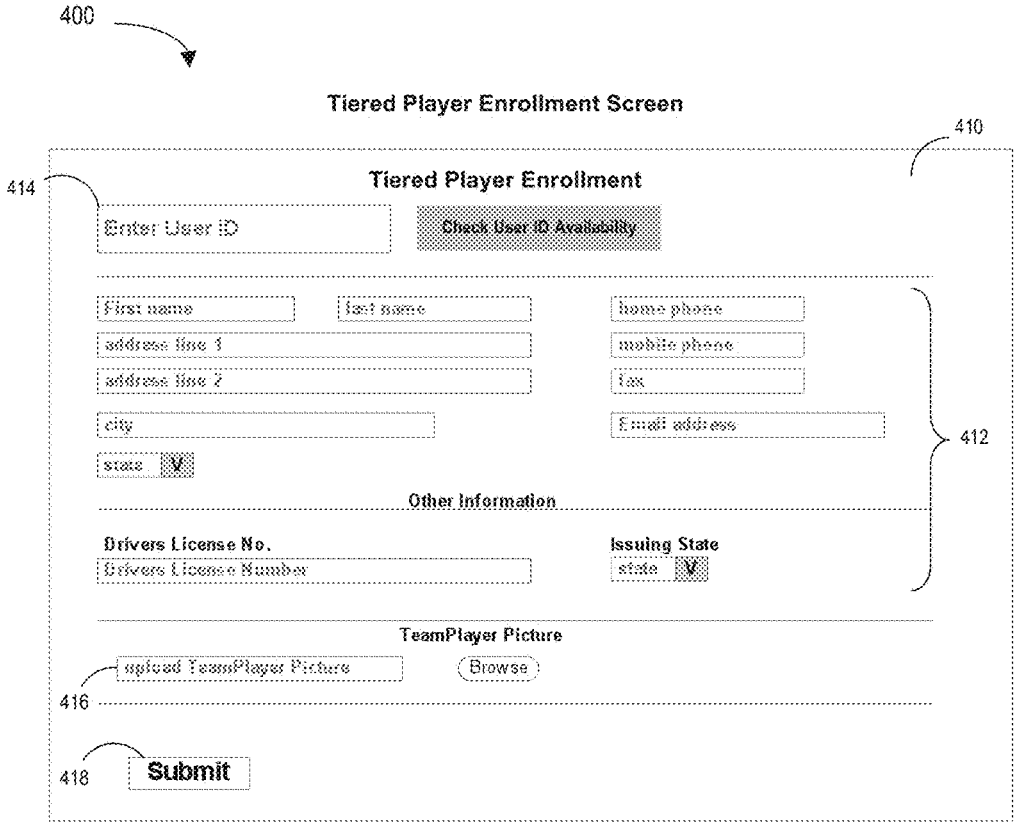
FIG. 8 is a schematic of an exemplary enrollment screen layout of a table game multiplier system according to one or more aspects of the present invention.

In order to enroll, in one embodiment, a tiered player 108 may utilize application software on the electronic telecommunication device 160 that connects to the game server 164 or other suitable server in the system 100, as may be provided, to complete the enrollment process. In another embodiment, a tiered player 108 may utilize a web browser that connects to the game server 164 or other suitable server in the system 100, as may be provided, to complete the enrollment process. In yet another embodiment, system operator 101 personnel (or other authorized personnel) may complete the enrollment process for the tiered player 108 using information supplied by the tiered player 108. The system operator 101 personnel may utilize application software on an electronic telecommunications device that connects to the game server 164 or other suitable server in the system 100, as may be provided, to complete the enrollment process for the tiered player 108. Alternatively, the system operator 101 personnel may utilize a web browser that connects to the game server 164 or other suitable server in the system 100, as may be provided, to complete the enrollment process for the tiered player 108. In each of these embodiments, an enrollment screen 400 (see FIG. 8) may display an electronic form 410 containing various data entry fields to collect information about the tiered player 108. Referring to FIG. 8, an exemplary electronic form 410 is shown. A tiered player 108 may be assigned a unique identifier, such as an identification name and/or number so that the tiered player 108 may be easily identified within the system 100. The identifier may be assigned by the system operator 101. The identifier may be entered into the electronic form 410 in field 414. To enroll, the tiered player 108 may provide the system operator 101 with personal information such as, but not limited to, his or her name, date of birth, contact information (e.g. phone number, address, e-mail address, etc.), photo identification (e.g. drivers license, passport, etc.), drivers license number and issuing state, credit/debit card/bank account information, and tax forms. Such information may be entered into various fields in field area 412, as may be provided in the electronic form 410. A photo of the tiered player 108 may be uploaded during the enrollment process in field 416.

Upon completing the electronic form 410, the information may be entered into the system 100 by activating a submit button 418, thereby creating an entry for the tiered player 108. Such information may be stored in the system operator's 101 management system 102 or elsewhere within the system 100, such as on database 110 or 168, for example.

When a tiered player 108 enrolls with the system operator 101, a player system account 178 is set up for the tiered player 108. Once the player system account 178 is set up, a tiered player 108 may set up authentication credentials for logging in to the system 100 as well as his or player system account 178. Such authentication credentials may include, but not be limited to, a Personal Identification Number (PIN), a user login, and a password. The player system account 178 may be used to store deposits on behalf of a tiered player 108. The player system account 178 may be denominated in different currencies or other fungible assets such as, but not limited to, BitCoin digital currency. The player system account 178 may be a collection of one or more balances on deposit used by the tiered player 108 to place bets in the system 100. A tiered player 108 may increase the balance(s) stored in the player system account 178 by adding money denominated in various acceptable currencies or a credit card or debit card or other mechanism where the system operator 101 receives irrevocable custody and title to a currency or fungible asset. A tiered player 108 may credit his or her player system account 178 by using a credit card or debit card, by an Automated Clearing House (ACH) transfer from his or her commercial bank account (e.g. Bank of America, Chase, etc. or other type of financial institution, or other types of electronic funds, such as BitCoin, for example. In one embodiment, the system operator 101 may allow the tiered player 108 to establish a line of credit and the system operator 101 may deposit funds as a loan into the player system account 178 on behalf of the tiered player 108. This is known in the industry as a "Marker" or "IOU." When a tiered player 108 is making bets, the balance of the tiered player's player system account 178 may be credited with amounts from winning a bet and debited when losing a bet.

At step 302, after setting up a player system account 178 with the system operator 101, the tiered player 108 may log in to the system 100 utilizing an electronic telecommunication device 160 to access various aspects of the system 100 that may be authorized for player access including, for example, his or her player system account 178, the game client 158, tiered craps games, and tiered craps table(s) 162.

At step 304, a shooter 104 and any live-action player(s) 106 who may be present and ready for play at a live-action craps table 112 within the system 100 may be identified. Such players may be identified by their unique identification codes or identification numbers or some other type of identification. This lets the tiered player 108 know that a live-action craps table 112 is ready for play and, accordingly, that a tiered craps table 162 associated with the live-action craps table 112 is available to the tiered player 108 for playing a tiered craps game. (Since a tiered craps game requires an underlying live-action craps table game being played at a live-action craps table 112, no tiered craps game may commence until such time as a live-action craps table game commences.)

At step 306, utilizing available funds in his or her player system account 178, a tiered player 108 may purchase virtual chips 156 from the system operator 101 to fill his or her virtual chip tray 154 with virtual chips 156 which the tiered player 108 will use at the tiered craps table 162 for placing bets on the outcome of a roll of each die of the pair of dice or a series of rolls of each die of the pair of dice (as may be determined by the system operator 101 in certain cases) occurring at the live-action craps table 112.

At step 308, once the tiered player 108 has purchased virtual chips 156 for his or her virtual chip tray 154, the tiered player 108 is then taken to the main game screen 180 that appears on the tiered player's 108 electronic telecommunication device 160, from which the tiered player 108 may place bets in a tiered craps game. The main game screen 180 may comprise an electronic display featuring the tiered craps table 162. Before the shooter 104 has made an initial roll of the dice (i.e., the "come out" roll), a tiered player 108 may indicate at the main game screen 180 that he or she wishes to place an initial allowed bet.

At step 310, once the main game screen 180 appears on the tiered player's 108 electronic telecommunication device 160, the tiered player 108 may place his or her initial allowed bet(s). (The shooter 104 and any live-action player (s) 106 may place their respective bets at the live-action craps table 112 at the appropriate time according to the rules of play for conventional casino craps or as otherwise allowed by the particular system operator 101.) To do so, the tiered player 108 may touch the virtual chip tray 154 appearing on the main game screen 180 containing the virtual chips 156, and then drag one or more virtual chips 156 from his or her virtual chip tray 154 across the main game screen 180 to any allowable betting area on the layout 182 of the tiered craps table 162 appearing on the main game screen 180, just as if he or she were physically present at the live-action craps table 112, all according to the rules of play for conventional casino craps (or as otherwise may be determined by the particular system operator 101). According to another embodiment, the tiered player 108 may place one or more virtual chips 156 by clicking on the virtual chip 156 and then dragging it to the appropriate section of the tiered craps table 162 appearing on the main game screen 180.

At step 312, once the tiered player 108 has confirmed his or her initial bet, the main game screen 180 appearing on the tiered player's 108 electronic telecommunication device 160 disappears and may be replaced by live video and audio, including video stream 172, of the live-action craps table 112. In this way, tiered players 108 may watch and listen to the action occurring at the live-action craps table 112 in real time.

At step 314, the shooter 104 rolls the dice for his or her come out roll at the live-action craps table 112. If it is the first time that the shooter 104 rolls the dice during the live-action craps table game, this is referred to as the shooter's 104 initial come out.

At step 316, once the roll of each die of the pair of dice is completed, a system operator 101 employee (e.g. a croupier) enters the outcome of the roll of each die of the pair of dice into the system 100 by utilizing the pit control 170 (or by some other suitable method). The outcome may then be communicated electronically from the pit control 170 to the tote board 144 (where it will be displayed to the shooter 104, live-action players 106, and others who may be physically present at the live-action craps table 112) and to the game server 164, via network 174.

At step 318, once the outcome of the roll of each die of the pair of dice has been entered into the system 100, the live video and audio of the live-action craps table 112 ceases displaying on the tiered player's 108 electronic telecommunication device 160 and is replaced by the main game screen 180.

At step 320, once the outcome of the roll of each die of the pair of dice has been entered into the system 100 and communicated to the game server 164, a determination can then be made at the game server 164 as to whether each tiered player 108 won, lost, or had a "no action" on the particular roll. The game server 164 may then communicate the outcome of the roll of each die of the pair of dice to the game client 158 (where it will be displayed to tiered players 108 utilizing the game client 158 on their respective electronic telecommunication devices 160), via network 174. The game client 158, in turn, may then display the outcome of the roll of each die of the pair of dice to the tiered player 108 on the main game screen 180 of the tiered player's 108 electronic telecommunication device 160 as it pertains to the particular tiered player 108 (i.e., a win, a loss, or no action, based upon the particular tiered player's 108 bet(s)).

At step 322, if the outcome of the roll is a natural winner or loser (i.e., a 7, 11, 2, 3, or 12), then the process advances to step 324. At step 324, any bet lost by a tiered player 108 may be immediately electronically debited from the tiered player's 108 player system account 178, and any bet won by a tiered player 108 may be immediately electronically credited to the tiered player's 108 player system account 178, along with any applicable winnings earned by the tiered player 108 as a result of the tiered player's 108 winning bet. The process then returns to step 310, where a tiered player 108 may place another bet in anticipation of a shooter's 104 repeat come out roll (which will occur at step 314). Conversely, at step 322, if the outcome of the come out roll is not a natural winner or loser, but rather, is a point (i.e., a 4, 5, 6, 8, 9, or 10), then, at step 326, the shooter's 104 point is established.

At step 328, after the shooter 104 has completed his or her come out roll, a tiered player 108 may decide that he or she wishes to place an additional allowed bet(s) (according to the rules of play for conventional casino craps or as otherwise allowed by the particular system operator 101), in a similar manner as described at step 310. Thus, if the tiered player 108 wishes to place any additional bet(s), then the process advances to step 330. At step 330, the tiered player 108 places his or her additional allowed bet(s), in the same manner that the tiered player 108 placed his or her initial allowed bet(s) at step 310. At step 332, once the tiered player 108 has confirmed his or her additional bet(s), the main game screen 180 disappears and live video and audio, including video stream 172, of the live-action craps table 112 may be displayed on the tiered player's 108 electronic telecommunication device 160. If the tiered player 108 does not wish to place any additional bet(s), then the process advances from step 328 directly to step 332.

At step 334, the shooter 104 rolls the dice again. At step 336, once the roll of the dice is completed, a system operator 101 employee (e.g. a croupier) may enter the outcome of the roll of each die of the pair of dice into the system 100 by utilizing the pit control 170 (or by some other suitable method). The outcome may then be communicated electronically from the pit control 170 to the tote board 144 (where it will be displayed to the shooter 104, live-action players 106, and others who may be physically present at the live-action craps table 112) and to the game server 164, via network 174.

At step 338, once the outcome of the roll of each die of the pair of dice has been entered into the system 100, the live video and audio of the live-action craps table 112 ceases displaying on the tiered player's 108 electronic telecommunication device 160 and is replaced by the main game screen 180.

At step 340, once the outcome of the roll of each die of the pair of dice has been entered into the system 100 and communicated to the game server 164, a determination can then be made at the game server 164 as to whether each tiered player 108 won, lost, or had a "no action" on the particular roll. The game server 164 may then communicate the outcome of the roll of each die of the pair of dice to the game client 158 (where it will be displayed to tiered players 108 utilizing the game client 158 on their respective electronic telecommunication devices 160), via network 174. The game client 158, in turn, may then display the outcome of the roll of each die of the pair of dice to the tiered player 108 on the main game screen 180 of the tiered player's 108 electronic telecommunication device 160 as it pertains to the particular tiered player 108 (i.e., a win, a loss, or no action, based upon the particular tiered player's 108 bet(s)).

At step 342, if the outcome of the roll is a 7, then the shooter 104 has sevened out and loses the right to roll the dice. The process then returns to step 324, where any bet lost by a tiered player 108 may be immediately electronically debited from the tiered player's 108 player system account 178, and any bet won by a tiered player 108 may be immediately electronically credited to the tiered player's 108 player system account 178, along with any applicable winnings earned by the tiered player 108 as a result of the tiered player's 108 winning bet. The process then returns to step 310, where a tiered player 108 may place bet(s) in anticipation of another shooter's 104 come out roll (which will occur at step 314).

At step 342, if the outcome of the roll is not a 7 then, at step 344, if the outcome of the roll is the point, then the shooter 104 has made the point. The process then returns to step 324, where any bet lost by a tiered player 108 may be immediately electronically debited from the tiered player's 108 player system account 178, and any bet won by a tiered player 108 may be immediately electronically credited to the tiered player's 108 player system account 178, along with any applicable winnings earned by the tiered player 108 as a result of the tiered player's 108 winning bet. The process then returns to step 310, where a tiered player 108 may place bet(s) in anticipation of a shooter's 104 repeat come out roll (which will occur at step 314).

If, at step 344, the outcome of the roll is not the point, steps 332 through 344 may then repeat, until such time as: the shooter 104 sevens out at step 342 and the dice are passed to a new shooter 104 who may commence his or her come out roll (at which point the process will eventually go back to step 310 in anticipation of a new shooter 104); or the tiered player 108 decides, at an allowable time (according to the rules of play for conventional casino craps or as otherwise allowed by the particular system operator 101), to quit playing the tiered craps game.

Further, if, at step 344, the outcome of the roll is not the point, and the tiered player 108 has placed additional bet(s) at step 328 warranting a credit or debit to the tiered player's 108 player system account 178 at this time, then such a credit or debit may be immediately performed by the system 100 accordingly.

Figure 9A:
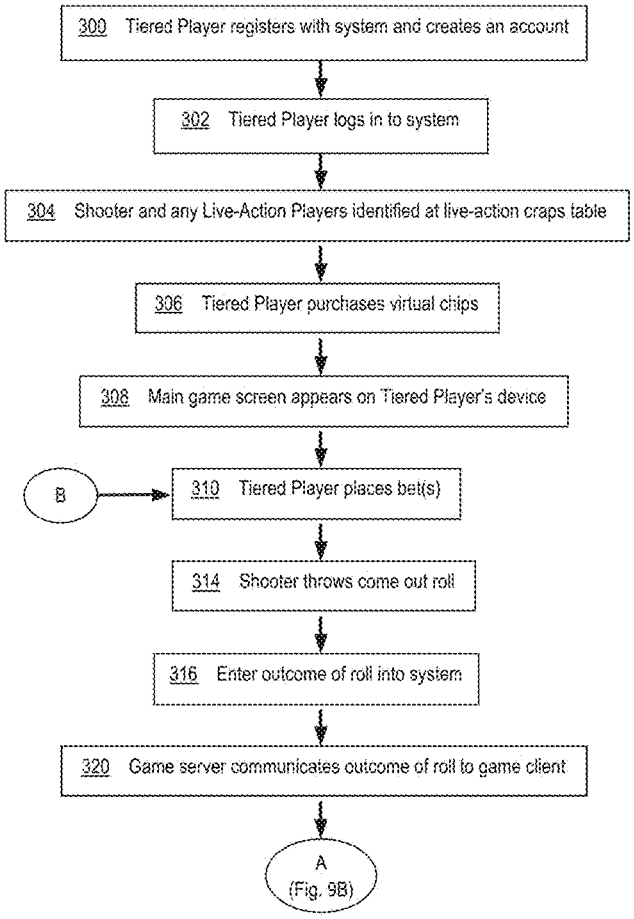
FIGS. 9A and 9B, taken together, are an exemplary flow chart depicting a method for allowing tiered players to place wagers on the outcome of at least one roll of each die of a pair of dice occurring during a live-action craps table game at a live-action craps table according to one or more aspects of the present invention.
Figure 9B:
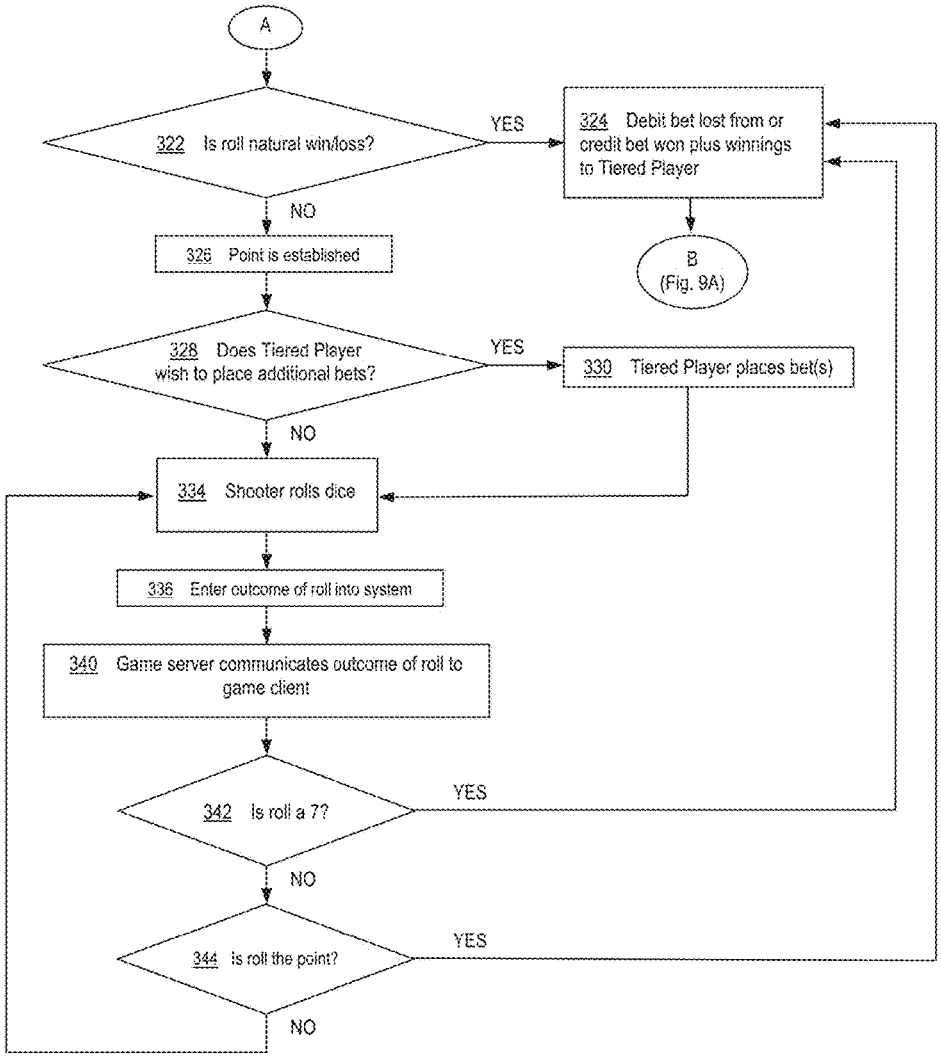

Referring now to FIGS. 9A-9B, a flowchart providing another exemplary embodiment of a method according to the present invention is shown. This embodiment is similar to the embodiment shown in FIGS. 7A-7B, except that live video and audio of the live-action craps table 112 are not provided. For the same reasons discussed above, this embodiment is particularly well-suited for situations in which electronic telecommunication devices 160 and tiered players 108 operating the electronic telecommunication devices 160 are located outside of the system operator 101, where bandwidth for providing video and audio on the electronic telecommunication devices 160 may be limited. It should be clearly understood, however, that this embodiment may be employed regardless of whether the electronic telecommunication devices 160 and tiered players 108 are located outside or within the system operator 101.

At step 308, the main game screen 180 appears on the tiered player's 108 electronic telecommunication device 160. At step 310, the tiered player 108 may place his or her initial allowed bet(s). The main game screen 180 remains on the tiered player's 108 electronic telecommunication device 160 and the process then advances to steps 314-316, as described above. Thereafter, the main game screen 180 remains on the tiered player's 108 electronic telecommunication device 160 and the process then advances to steps 320-330, as described above. Thereafter, the main game screen 180 remains on the tiered player's 108 electronic telecommunication device 160 and the process then advances to steps 334-336, as described above. Thereafter, again, the main game screen 180 remains on the tiered player's 108 electronic telecommunication device 160 and the process advances to steps 340-344 etc., as discussed above.

When utilizing the system 100, all winnings and losses from each tiered craps game may be reported to appropriate taxing authorities, following standard protocols.

According to one embodiment, the system 100 may include a geographic location tracking component through which a tiered player's 108 geographic location may be tracked and/or confirmed, in order to establish that the tiered player 108 is located within the bounds of a predetermined geographic area in which the tiered player 108 would be permitted to gamble, according to the laws of the applicable jurisdiction. This may be accomplished through various known geolocation methods, such as global satellite positioning ("GPS") and the like, according to the law's of the applicable jurisdiction. If it is determined that the tiered player 108 is within the bounds of a permitted geographic area, then the tiered player 108 would be permitted to play in a tiered craps game. Conversely, if it is determined that the tiered player 108 is not within the bounds of a permitted geographic area, then the tiered player 108 would be prohibited from playing in a tiered craps game. According to one embodiment, the determination of whether or not the tiered player 108 is within the bounds of a permitted geographic area may be made upon the tiered player 108 logging in to the system 100.

According to one embodiment, when utilizing the system 100, the system operator 101 may determine a select number of players who will be permitted to play at any given time. Thus, the system operator 101 may determine that a limited number of tiered players 108 may be permitted to play in a particular tiered craps game. In addition, or alternatively, the system operator 101 may determine a select number of tiered craps tables 162 that will be utilized at any given time. According to another embodiment, the number of tiered players 108 permitted to play at a given time and/or the number of tiered craps games in play at a given time may be unlimited.

It may be possible that a dispute may arise while utilizing the system 100, such as, for example, a dispute regarding the actions of a shooter 104 or live-action player 106 during play. In such an event, various protocols may be followed. In this regard, if a tiered player 108 has a dispute with respect to the actions of any shooter 104 or live-action player 106 during play, or a dispute regarding any roll in general, the tiered player 108 may be required to notify the system operator 101 immediately after the particular play (e.g. roll of the dice) that triggered the dispute. In one embodiment, the game client 158 may include a notification feature through which a tiered player 108 may message or otherwise contact appropriate system operator 101 personnel to inform them of the dispute. The system operator 101 personnel may then resolve the dispute by reviewing video of the recorded play (as recorded by video camera(s) 146) and/or reviewing audit logs, and/or reviewing any other information, as may be appropriate, and then advising the players accordingly, following all applicable rules established by system operator 101. All winnings and losses may then be totaled and reported to the appropriate authorities, following standard protocols.

The system 100 allows for social groups to be formed and social events to be created. In this regard, according to one embodiment, tiered players 108 may be able to socialize with one another as a group or as individuals enjoying a social experience while playing a tiered craps game. The tiered players 108 may be able to talk, laugh, and root for the shooter 104 or even boo the shooter 104. Since the tiered players 108 would be located remotely from the live-action craps table 112, they would not be interfering with the shooter 104.

The system 100 allows for the playing of the game of craps in virtual reality. In one embodiment, a live-action craps table game being played at the live-action craps table 112 may be broadcast in virtual reality. In this embodiment, the tiered players 108 will be able to play the craps game as if they were present at the live-action craps table 112 while playing along with other virtual reality tiered players 108, thereby experiencing a tiered craps game with their friends and/or families, for example. In this embodiment, the use of virtual reality headsets would be required for virtual reality playing, along with virtual reality cameras. Each virtual reality tiered player 108 would wear a virtual reality headset, which may comprise a standard virtual reality headset known in the industry. One or more virtual reality cameras would be utilized, with each virtual reality camera configured to record a scene or scenes omnidirectionally, such as recording a scene(s) of the live-action craps table 112. In addition, the virtual reality tiered players 108 would each be required to have a player system account 178. In this embodiment, as an alternative to broadcasting in virtual reality, broadcasting may also be done by way of other methods including, but not limited to, broadcasting by streamed services or television, or by any other suitable electronic broadcast method.

Figure 10:
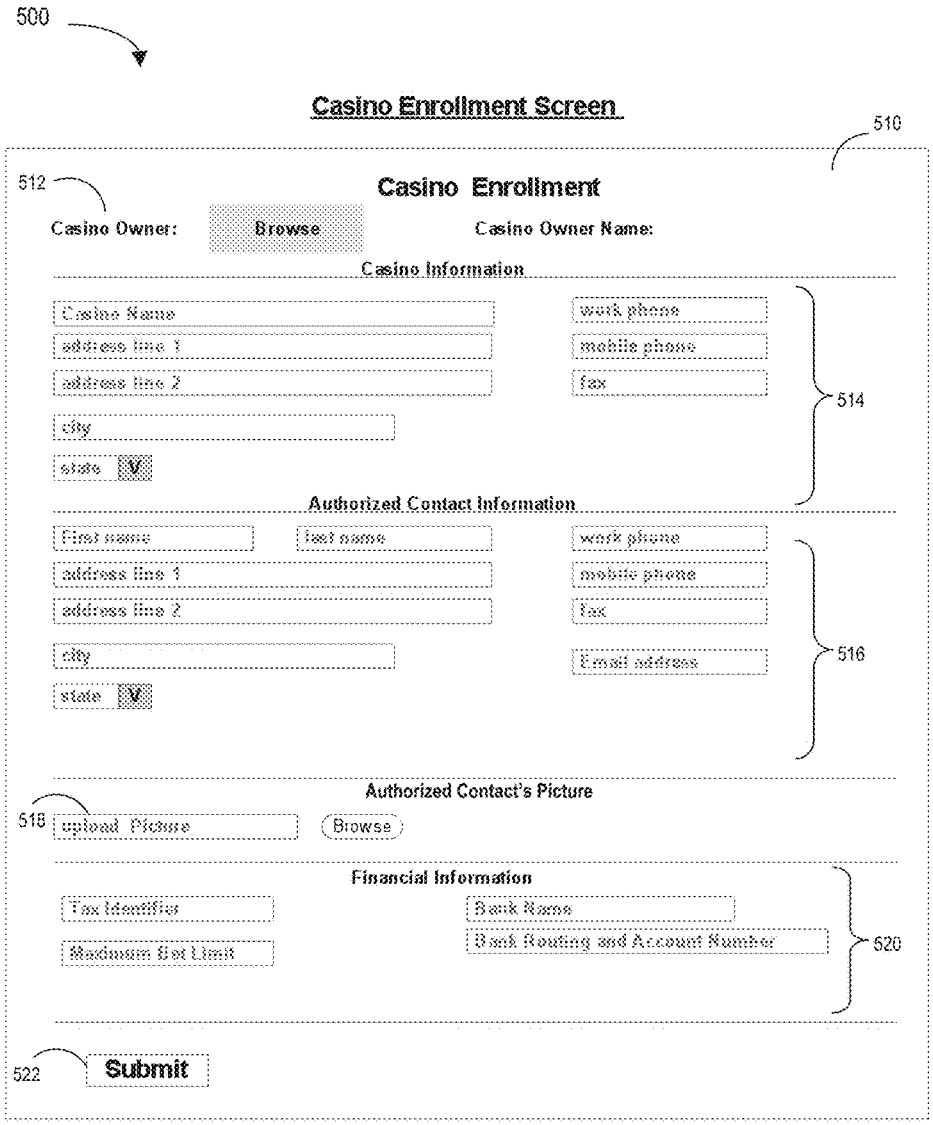
FIG. 10 is a schematic of an exemplary enrollment screen layout of a table game multiplier system according to one or more aspects of the present invention.

According to one embodiment, a system operator 101 may complete an enrollment process to utilize the system 100. In order to enroll, in one embodiment, an authorized representative of the system operator 101 may complete and submit an electronic form utilizing application software or a web browser. In this embodiment, an enrollment screen 500 (see FIG. 10) may display an electronic form 510 containing various data entry fields to collect information about the system operator 101. Referring to FIG. 10, an exemplary electronic form 510 is shown. In this example, the system operator 101 is a casino. However, it should be clearly understood that the system operator 101 may be an entity other than a casino, including any suitable establishment where a craps table game may be played. The enrollment screen 510 may include field 512 for identifying the system operator 101 owner. To enroll, the system operator 101 may provide various information such as, but not limited to, the system operator's 101 name and contact information (address, phone and facsimile numbers, etc.). Such information may be entered into various fields in field area 514. The system operator 101 may further provide a name and contact information (address, phone and facsimile numbers, e-mail address, etc.) for its authorized representative. Such information may be entered into various fields in field area 516. A photo of the system operator's 101 authorized representative may be uploaded during the enrollment process in field 518. In addition, the system operator 101 may provide various financial information, such as a tax identifier, maximum bet limit, bank name, and bank routing and account number. Such information may be entered into various fields in field area 520.

Upon completing the electronic form 510, the information may be submitted by activating a submit button 522, thereby creating an entry for the system operator 101. According to one embodiment, the electronic form 500 may be submitted to a third party service provider that provides the system 100 to one or more system operators 101.

According to one embodiment, the system 100 may be utilized at multiple locations simultaneously. In this embodiment, system 100 may comprise a plurality of system operators 101 networked with one another, wherein each system operator 101 hosts its own live-action craps table(s) 112. In this way, a network of multiple tiered system operators 101 may thus be established. In this embodiment, each tiered system operator 101 may be assigned a unique identifier, such as a name, identification number, or identification code, so that they may be easily identified within the system 100. By providing a network of multiple tiered system operators 101 in the system 100, tiered players 108 may have additional options available to them when playing tiered craps games. In this regard, in jurisdictions where such activity may be permitted, tiered players 108 may choose a desired live-action craps table 112 from among an offering of live-action craps tables 112 available for play at the multiple tiered system operators 101 and then play a tiered craps game associated with the live-action craps table game at the particular selected tiered system operator 101.

The system 100 allows progressive jackpots. Progressive jackpots in the gambling industry are generally based on a predetermined winning combination(s) that is typically difficult to obtain and having an element of chance. With the system 100 able to keep track of all bets placed and all rolls of each die of the pair of dice, a progressive jackpot may be established among the tiered players 108 at any system operator 101 individually (e.g. a local progressive jackpot) and/or multiple system operators 101 collectively (e.g. a multi-system operator 101 progressive jackpot). With a multi-system operator 101 progressive jackpot, multiple system operators 101 may be involved, with each individual system operator 101 utilizing its own system 100. As one example of a progressive, a progressive jackpot could be won if the point is hit by the same shooter 104 ten times (by establishing ten points, i.e., a 4, 5, 6, 8, 9, or 10, and then having the shooter 104 hit those points before sevening out and losing his or her roll). However, a progressive jackpot could be based on more or less than ten points. As another example, a progressive jackpot could be won when a specific combination(s) is rolled multiple times consecutively (e.g. rolling three hard twelves in a row or rolling three snake eyes in a row). The foregoing are provided as examples and should not be seen in a limiting manner.

According to one embodiment, a local progressive jackpot may be established. In this embodiment, an individual system operator 101 employing its own local progressive jackpot may determine its own local progressive jackpot winning bet. In order for a tiered player 108 to qualify for a local progressive jackpot, the tiered player 108 would first be required to make a qualifying progressive side bet on the local progressive jackpot. The qualifying progressive side bet may be determined by the individual system operator 101. If a local progressive jackpot is hit on a particular roll, all tiered players 108 who placed a qualifying progressive side bet on that particular roll may share in the local progressive jackpot winnings proportionally. Prior to paying each winning progressive bettor, the system operator 101 may deduct appropriate ax withholdings.

According to another embodiment, a multi-system operator 101 progressive jackpot may be established. In this embodiment, the multi-system operator 101 progressive jackpot may be overseen by one or more multi-system operator 101 progressive jackpot managers (or some other suitable authority). In this embodiment, the multi-system operator 101 progressive jackpot winning bet may be determined by the multi-system operator 101 progressive jackpot manager(s) or some other suitable authority. In order for a tiered player 108 to qualify for the multi-system operator 101 progressive jackpot, the tiered player 108 would first be required to make a qualifying progressive side bet on the multi-system operator 101 progressive jackpot. The qualifying progressive side bet may be determined by the multi-system operator 101 progressive jackpot manager(s) or some other suitable authority. If a multi-system operator 101 progressive jackpot is hit on a particular roll, all tiered players 108 who placed a qualifying progressive side bet on that particular roll may share in the multi-system operator 101 progressive jackpot winnings proportionally. In this embodiment, all system operators 101 anywhere in the world that utilize the system 100 and participate in the multi-system operator 101 progressive jackpot may be part of a multi-system operator 101 network. In this regard, the multi-player craps games provided by each system operator 101 within the multi-system operator 101 network may be electronically connected to a global network, wherein each roll of the dice by each shooter 104 may be recorded/tracked in real time. In this way, once a multi-system operator 101 progressive jackpot is won, a new multi-system operator 101 progressive jackpot may start to accumulate. In this embodiment, each system operator 101 within the multi-system operator 101 network may be assigned a unique identifier, such as a name, identification number, or identification code, so that they may be easily identified within the multi-system operator 101 network. According to one embodiment employing the multi-system operator 101 progressive jackpot, each multi-system operator 101 progressive jackpot bet may be allocated as follows: a first portion of the bet may go to the multi-system operator 101 progressive jackpot to be paid to the eventual winner(s); a second portion of the bet may go to the system operator 101; and a third portion of the bet may go to the multi-system operator 101 progressive jackpot manager(s). Prior to paying each winning progressive bettor, the multi-system operator 101 progressive jackpot manager(s) may deduct appropriate tax withholdings.

The foregoing description is illustrative of particular embodiments of the invention, but is not meant to be a limitation upon the practice thereof. While embodiments of the disclosure have been described in terms of various specific embodiments, those skilled in the art will recognize that the embodiments of the disclosure may be practiced with modifications within the spirit and scope of the claims. For example, while the invention has been described with reference to the game of craps, it will be readily appreciated by those skilled in the art that the concepts set forth in the disclosure can be applied to other forms of casino games without departing from the spirit and scope of the invention.

What is claimed is:

1. A table game multiplier system, comprising:

at least one live-action craps table residing at a system operator, the system operator having a plurality of servers;

a network configured for communication between at least one server of the plurality of servers and at least one electronic telecommunication device operated by at least one tiered player enrolled with the system operator, wherein the at least one tiered player is located remotely from the live-action craps table;

a game client, wherein the game client comprises application software configured to run on the at least one electronic telecommunication device, wherein the application software is configured to display an interactive tiered craps table on the at least one electronic telecommunication device, wherein the tiered craps table is a virtual representation of at least a portion of a layout of the live-action craps table, and wherein the tiered craps table is configured for accepting at least one wager placed by the at least one tiered player on a game of craps being played at the at least one live-action craps table, as if the at least one wager was being placed at the at least one live-action craps table;

a virtual chip tray server communicatively coupled to the game client, wherein the virtual chip tray server is configured for the at least one tiered player to purchase virtual chips for placing wagers on the tiered craps table;

wherein the virtual chip tray server has a first database containing information for at least one virtual chip tray utilized by the at least one tiered player, and a first processor configured to access the first database and to execute a set of program instructions causing the first processor to process a first input received from the at least one electronic telecommunication device operated by the at least one tiered player, wherein the first input comprises at least one e-commerce transaction initiated by the at least one tiered player for purchasing the virtual chips;

a game server communicatively coupled to the game client; and a pit control communicatively coupled to the game server, wherein the pit controls configured to transmit to the game server an outcome of each roll of each die of a pair of dice performed by a shooter in the game of craps being played at the live-action craps table.

2. The system of claim 1 wherein the at least one electronic telecommunication device is one of a smartphone, a tablet computer, and a personal computer.

3. The system of claim 1 further comprising a management system connected to the network.

4. The system of claim 1 wherein the first processor is further configured to execute a set of program instructions causing the first processor to update a system account balance of the at least one tiered player depending upon the outcome of each roll of each die of the pair of dice, wherein:

the amount of the wager placed by the at least one tiered player is credited to the system account balance wherein the at least one tiered players wager is a winning wager; and the amount of the wager placed by the at least one tiered player is debited from the system account balance wherein the at least one tiered player's wager is a losing wager.

5. The system of claim 1 wherein the game server has a second database and a second processor configured to access the second database and to execute a set of program instructions causing the second processor to process a second input received from the at least one electronic telecommunication device operated by the at least one tiered player, wherein the second input comprises the at least one wager made by the at least one tiered player on the game of craps being played at the at least one live-action craps table.

6. The system of claim 5, wherein the second processor is further configured to execute a set of program instructions causing the second processor to process a third input received from the pit control, wherein the third input comprises the outcome of each roll of each die of the pair of dice.

7. The system of claim 1 further comprising an electronic tote board communicatively coupled to the pit control, wherein the tote board is configured to display the outcome of each roll of each die of the pair of dice.

8. The system of claim 1 further comprising a video stream broadcast to the game client, wherein video for the video stream is generated by at least one video camera recording the live-action craps table.

9. The system of claim 6 wherein the first processor is further configured to execute a set of program instructions causing the first processor to process a fourth input, wherein the fourth input comprises at least one e-commerce transaction initiated by the system operator for making at least one payout to the at least one tiered player.

10. The system of claim 1 wherein the pit control comprises application software configured to receive input of the outcome of each roll of each die of the pair of dice in the game of craps being played at the at least one live-action craps table.

11. A method for allowing tiered players to place wagers on an outcome of at least one roll of each die of a pair of dice occurring during a game of craps being played on at least one live-action craps table, comprising the steps of:

at least one tiered player logging in to a table game multiplier system, the tiered player located remotely from the at least one live-action craps table, wherein the system comprises:

the at least one live-action craps table, wherein the at least one live-action craps table sides at a system operator, the system operator having a plurality of servers;

a network configured for communication between at least one server of the plurality of servers and at least one electronic telecommunication device operated by at least one tiered player enrolled with the system operator;

a game client, wherein the game client comprises application software configured to run on the at least one electronic telecommunication device, wherein the application software is configured to display an interactive tiered craps table on the at least one electronic telecommunication device, wherein the tiered craps table is a virtual representation of at least a portion of a layout of the live-action craps table, and wherein the tiered craps table is configured for accepting at least one wager placed by the at least one tiered player on a game of craps being played at the at least one live-action craps table, as if the at least one wager was being placed at the at least one live-action craps table;

a virtual chip tray server communicatively coupled to the game client, wherein the virtual chip tray server is configured for the at least one tiered player to purchase virtual chips for placing the at least one wager on the tiered crap table;

a game server communicatively coupled to the game client; and a pit control communicatively coupled to the game server, wherein the pit control is configured to transmit to the game server an outcome of each roll of each die of the pair of dice performed by a shooter in the game of craps being played at the live-action craps table;

identifying via the system at least the shooter that is present and ready to commence play of the game of craps at the at least one live-action craps table;

the at least one tiered player placing at least one wager on the tiered craps table;

the shooter rolling the dice at the live-action craps table;

entering into the system data regarding the outcome of the roll of each die of the pair of dice;

transmitting to the game server the data regarding the outcome of the roll of each die of the pair of dice;

determining, at the game server, whether the tiered player's wager is one of a winning wager, a losing wager, and a no-action wager;

communicating to the game client the data regarding the outcome of the roll of each die of the pair of dice; and updating a system account balance of the at least one tiered player depending upon the outcome of the roll of each die of the pair of dice, wherein:

the amount of the wager placed by the at, least one tiered player is credited to the system account balance wherein the at least one tiered player's wager is a winning wager; and the amount of the wager placed by the at least one tiered player is debited from the system, account balance wherein the at least one tiered player's wager is a losing wager.

12. The method of claim 11 further comprising the step of identifying via the system at least one live-action player that is present at the live-action craps table.

13. The method of claim 11 further comprising the step of displaying on an electronic tote board of the system the outcome of each roll of each die of the pair of dice.

14. The method of claim 11 further comprising the step of providing a video stream broadcast to the game client, wherein video for the video stream is generated by at least one video camera, recording the live-action craps table.

15. The method of claim 11 further comprising the step of the system operator initiating at least one commerce transaction for making at least one payout to the at least one tiered player.

16. The method of claim 11 further comprising the step of receiving, via the pit control, input of the outcome of each roll of each die of the pair of dice in the game of craps being played at the at least one live-action craps table, wherein the pit control further comprises application software configured to run on an electronic telecommunication device.

17. A table game multiplier system, comprising:

at least one live-action craps table residing at a system operator, the system operator having a plurality of servers;

a network configured for communication between the at least one server of the plurality of servers and at least one electronic telecommunication device operated by at least one tiered player enrolled with the system operator, wherein the tiered player is located remotely from the live-action craps table;

a management system connected to the network;

a game client, wherein the game client comprises application software configured to run on the at least one electronic telecommunication device, wherein the application software is configured to display an interactive tiered craps table on the at least one electronic telecommunication device, wherein the tiered craps table is a virtual representation of at least a portion of a layout of the live-action craps table, and wherein the tiered craps table is configured for accepting at least one wager placed by the at least one tiered player on a game of craps being played at the at least one live-action craps table, as if the at least one wager was being placed at the at least one live-action craps table;

a virtual chip tray server communicatively coupled to the management system and to the game client, wherein the virtual chip tray server is configured for the at, least one tiered player to purchase virtual chips for placing the at least one wager on the tiered craps table, wherein the virtual chip tray server has a first database containing information for at least one virtual chip tray utilized by the at least one tiered player, and a first processor configured to access the first database and to execute a set of program instructions causing the first processor to process a first input received from the at least one electronic telecommunication device operated by the at least one tiered player, wherein the first input comprises at least one e-commerce transaction initiated by the at least one tiered player for purchasing the virtual chips;

a game server communicatively coupled to the game client, wherein the game server has a second database containing information for the at least one tiered player and a second processor configured to access the second database and to execute a set of program instructions causing the second processor to process a second input received from the at least one electronic telecommunication device operated by the at least one tiered players wherein the second input comprises the at least one wager made by the at least one tiered player on the game of craps being played at the at least one live-action craps table;

a pit control communicatively coupled to the game server, wherein the pit control is configured to transmit to the game server an outcome of each roll of each die of a pair of dice performed by a shooter in the game of craps being played at the live-action craps table;

an electronic tote board communicatively coupled to the pit control, wherein the tote board is configured to display the outcome of each roll of each die of the pair of dice;

a video stream broadcast to the game client, wherein video for the video stream is generated by at least one video camera recording the live-action craps table;

wherein the second processor is further configured to execute, a set of program instructions causing the processor to process a third input received from the pit control, wherein the third input comprises the outcome of each roll of each die of the pair of dice; and wherein the first processor is further configured to execute a set of program instructions causing the first processor to update a system account balance of the at least one tiered player depending upon the outcome of each roll of each die of the pair of dice, wherein:

the amount of the wager placed by the at least one tiered player is credited to the system account balance wherein the at least one tiered player's wager is a winning wager; and the amount of the wager placed by the at least one tiered player is debited from the system account balance wherein the at least one tiered player's wager is a losing wager.

18. The system of claim 17 wherein the second processor is further configured to access the second database and to execute a set of program instructions wherein the program instructions comprise establishing at least one progressive jackpot.

19. The system of claim 18 wherein the tiered craps table is further configured for accepting at least one progressive side bet placed by the at least one tiered player on the game of craps being played at the at least one live-action craps table and wherein the second processor is configured to access the second database and to execute a set of program instructions causing the second processor to process a fifth input received from the at least one electronic telecommunication device operated by the at least one tiered player, wherein the fifth input comprises the least one progressive side bet.

* * * * *